United States Patent [19]

Campman et al.

[11] 4,325,999

[45] Apr. 20, 1982

[54] BIAS FABRIC

[75] Inventors: Arthur R. Campman, Los Angeles; George K. Shibata, Whittier; William D. Cumming, Redondo Beach, all of Calif.

[73] Assignee: Hitco, Irvine, Calif.

[21] Appl. No.: 96,833

[22] Filed: Nov. 23, 1979

[51] Int. Cl.[3] ..... B32B 5/12

[52] U.S. Cl. ..... 428/112; 156/181; 428/121; 428/126; 428/142; 428/224

[58] Field of Search ..... 428/105, 107, 108, 109, 428/112, 192, 120, 224, 126, 121; 156/181, 177

[56] References Cited

U.S. PATENT DOCUMENTS

| | | | |
|---|---|---|---|
| 2,842,472 | 7/1958 | Haatstein | 428/110 |
| 3,039,169 | 6/1962 | Frickert | 428/112 |
| 3,321,348 | 5/1967 | Rupp | 156/177 |
| 3,598,166 | 8/1971 | Wells | 156/181 |
| 3,607,564 | 9/1971 | Rasho | 156/181 |
| 3,607,565 | 9/1971 | Eaton | 156/181 |
| 3,616,001 | 10/1971 | Addis | 156/177 |
| 3,729,365 | 4/1973 | Greene | 428/126 |
| 3,756,893 | 9/1973 | Smith | 156/181 |
| 4,071,647 | 1/1978 | McMullen | 428/121 |
| 4,080,232 | 3/1978 | Friedrich | 156/181 |
| 4,161,559 | 7/1979 | Bosse | 428/192 |

*Primary Examiner*—James J. Bell
*Attorney, Agent, or Firm*—Fraser and Bogucki

[57] ABSTRACT

A bias fabric having parallel, spaced-apart yarns oriented ±45° relative to the long axis of the fabric is formed by directing one or more pluralities of the yarns back and forth across the width of the fabric and securing the yarns around pins mounted on movable conveyors at the opposite sides of the fabric. Alternatively, the yarns are mounted on strips of film with the film strips being secured to the opposite conveyors. In one preferred embodiment one or more elongated yarn laying units arranged to supply yarns through apertures along the length thereof are cycled laterally between the opposite conveyors as the conveyors are moved at a controlled speed to form a 2-ply fabric, the yarns being wrapped around pins on the opposite conveyors using an adjustable roller arrangement mounted on the shuttle or a plurality of pin mounting rings the alternate ones of which move in unison so as to engage odd and then even numbered yarns in the yarn array. Slotted guides can be used in lieu of pins, with each different guide traversing a width of the fabric with the shuttle and then being mounted on a conveyor to hold the yarns in place. In an alternative embodiment, one or more rapier assemblies traverse the width of the fabric at a 45° angle to lay groups of yarns back and forth across the fabric. Each yarn group is disposed around two different sets of pins on each conveyor to complete the turnaround. The bias fabric is stabilized prior to removal from the conveyors by various techniques including stitching threads along the length thereof, depositing beads of molten plastic along the length thereof, attaching an adhesive coated film or impregnating with and at least partially curing a resin.

9 Claims, 25 Drawing Figures

FIG. 1
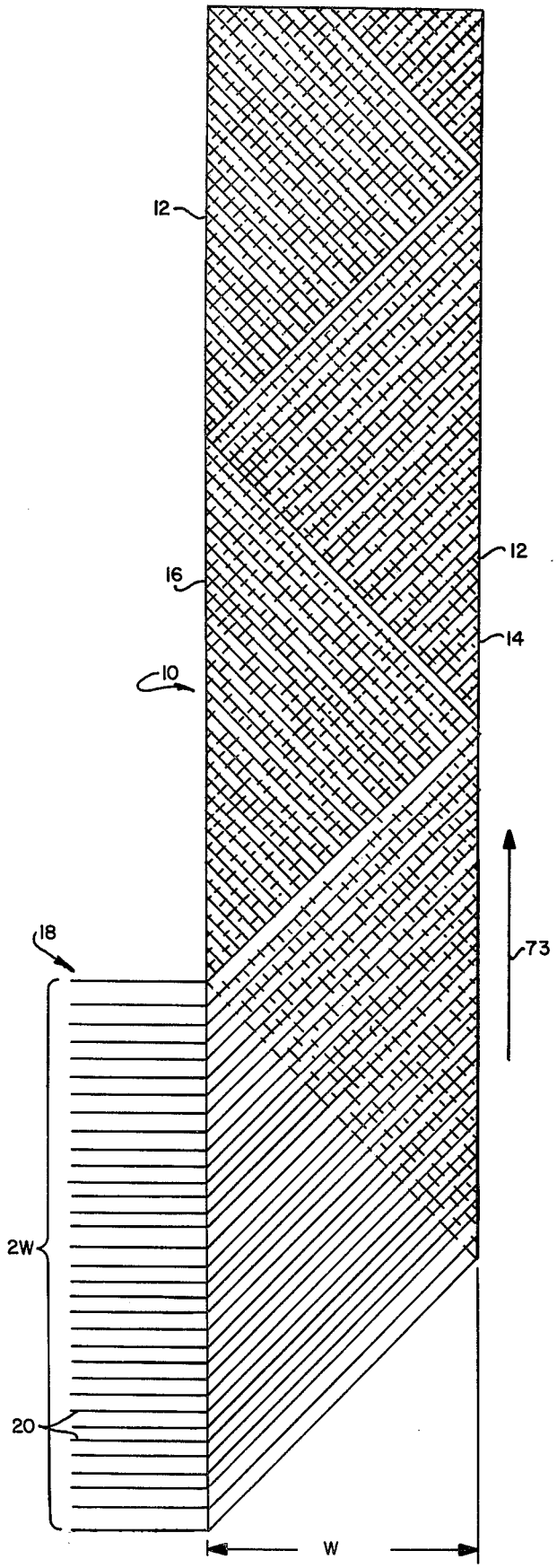
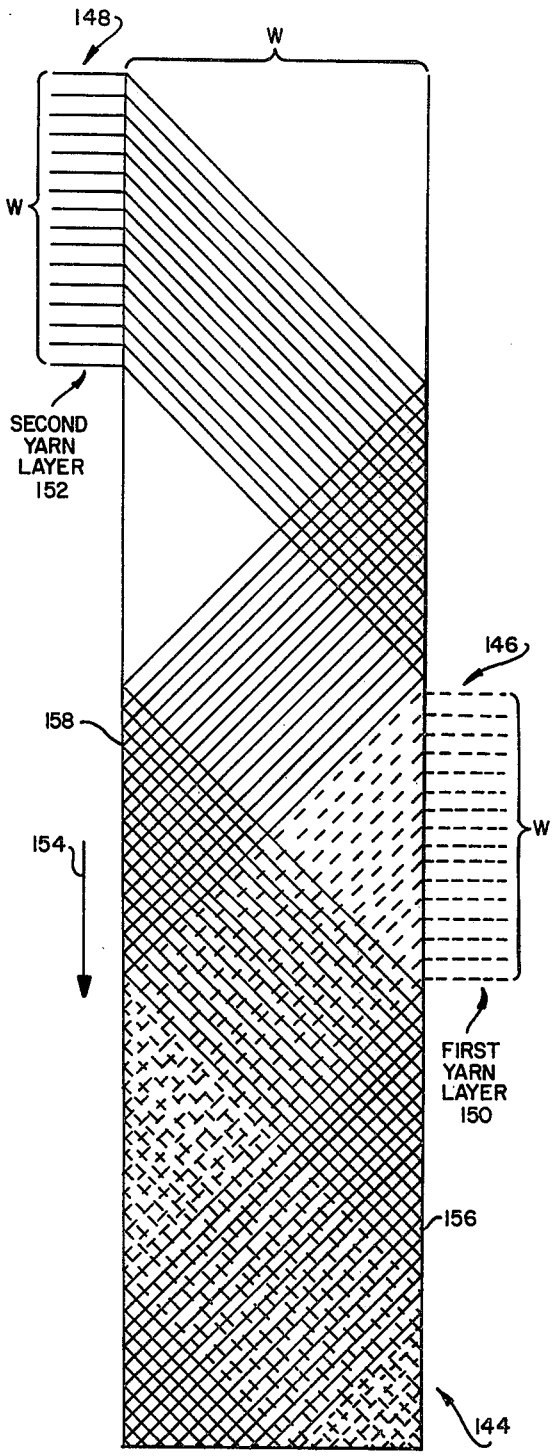
FIG. 8

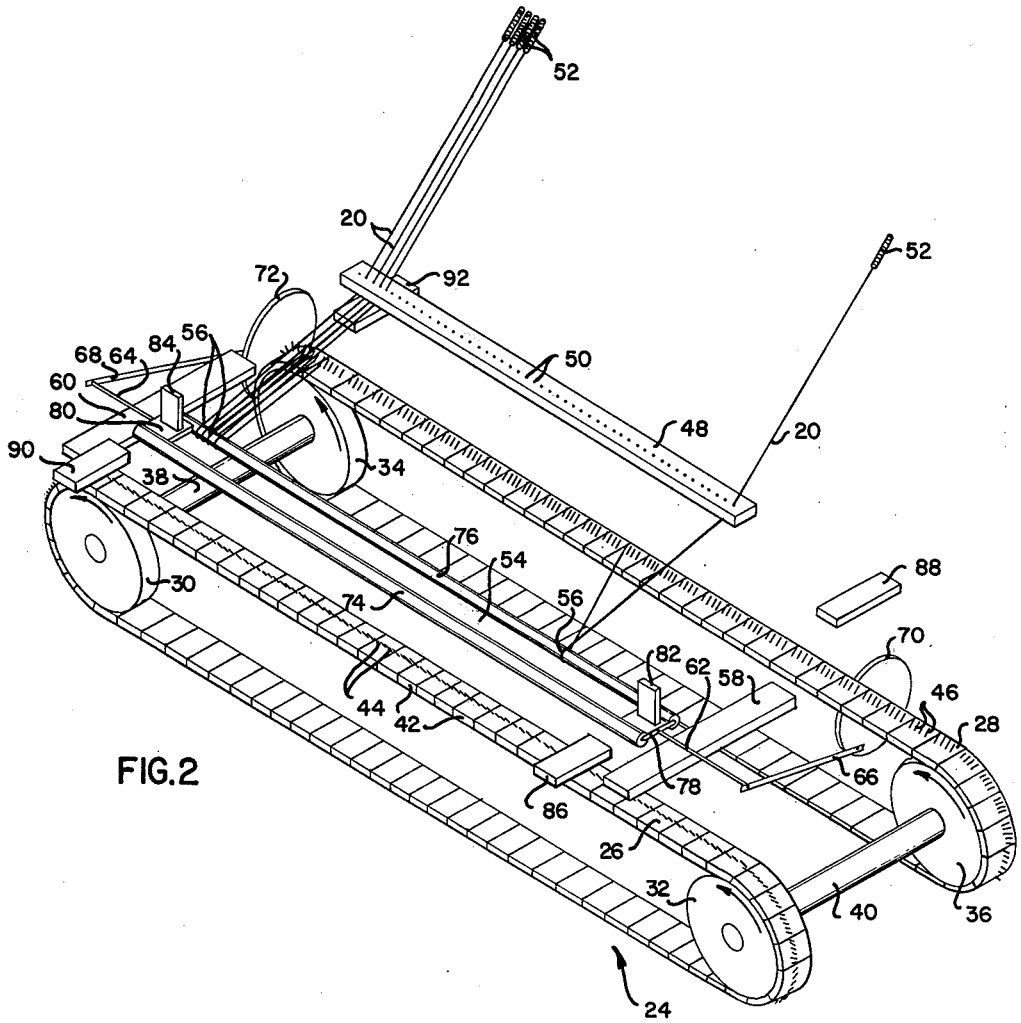
FIG.2
FIG.3
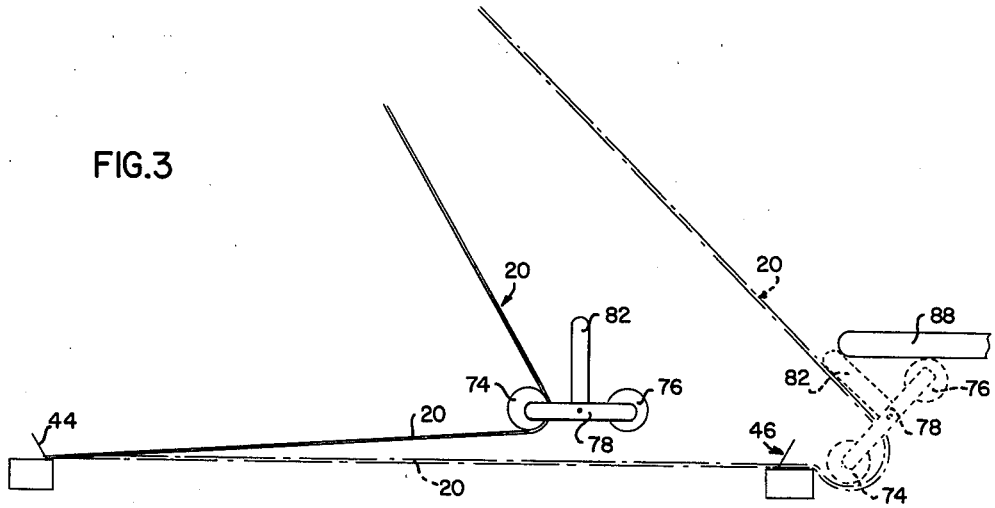

FIG.5
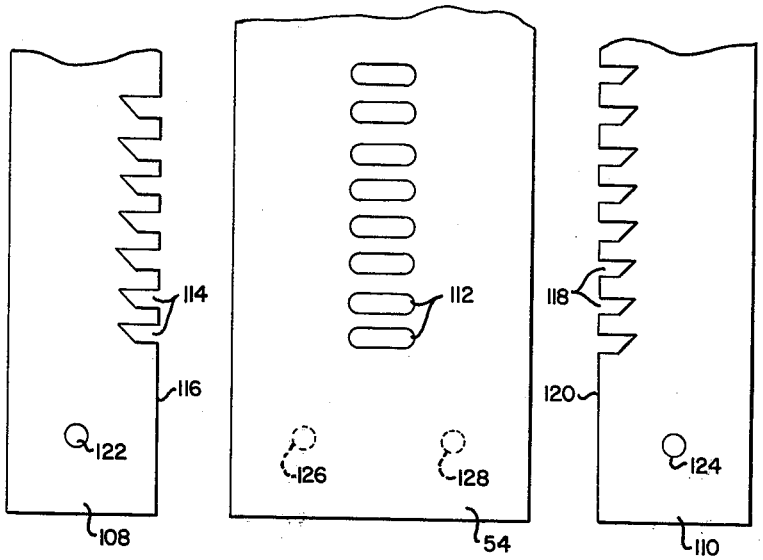
FIG.6
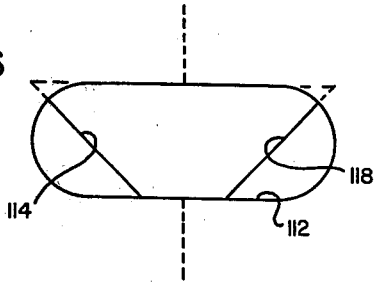
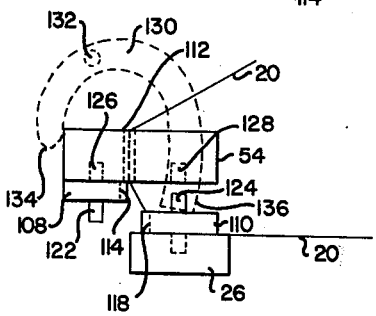
FIG.7A
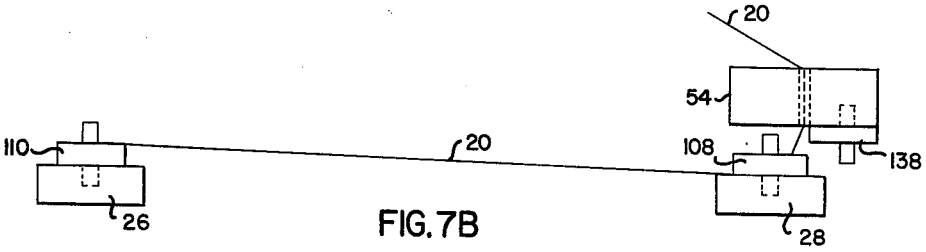
FIG.7B
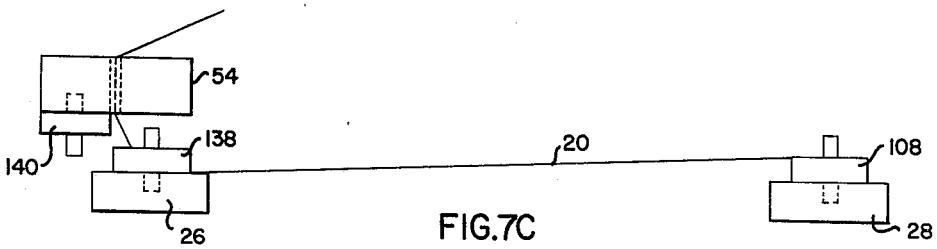
FIG.7C

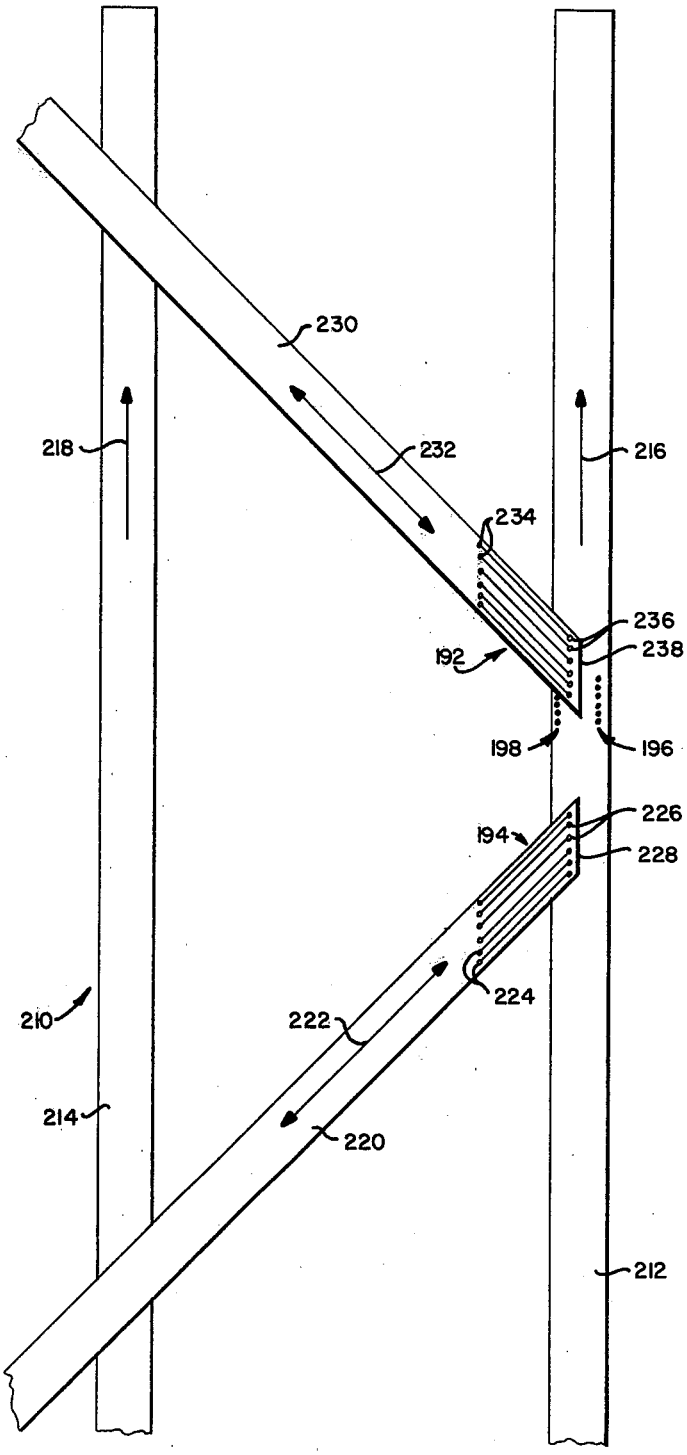
FIG. 11
FIG. 12
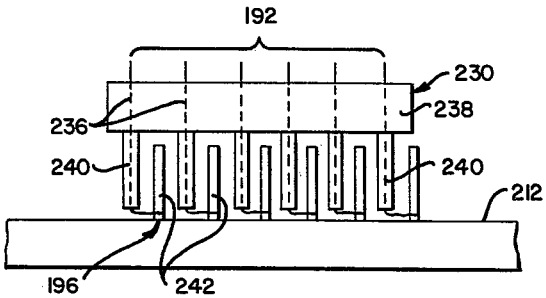

FIG.18
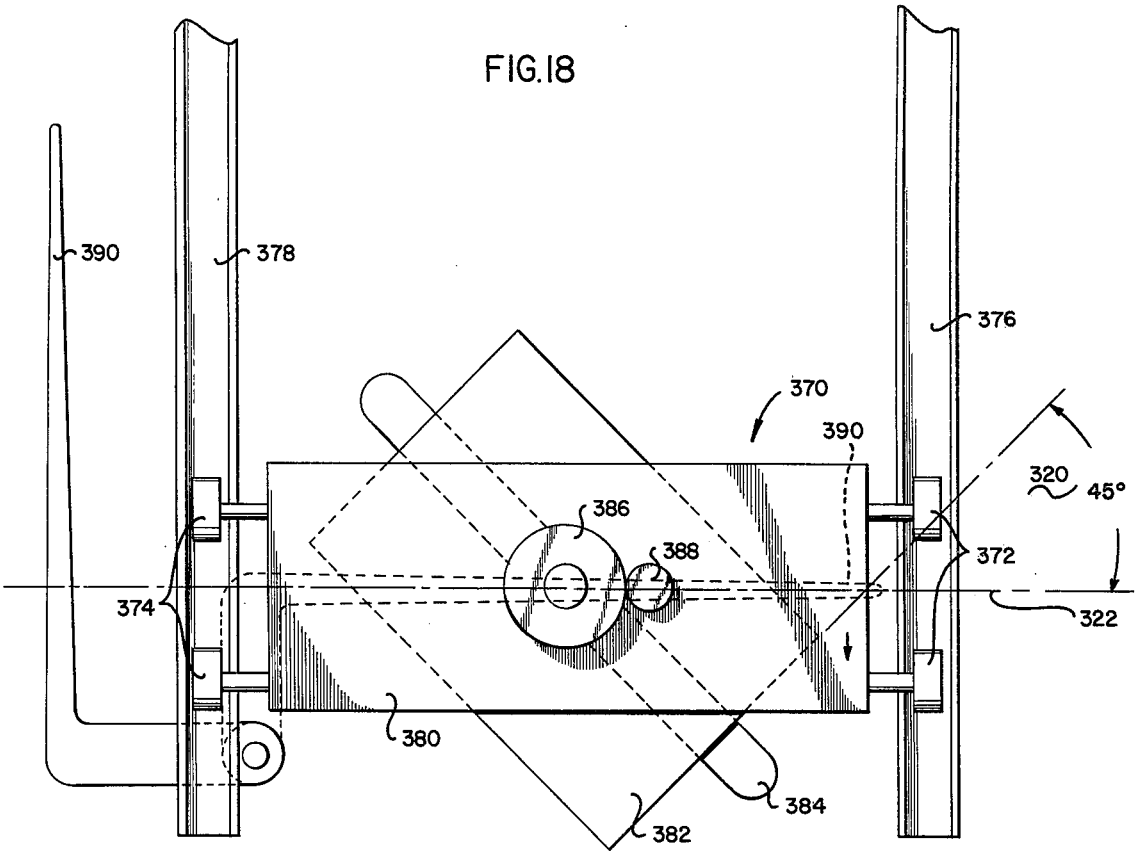
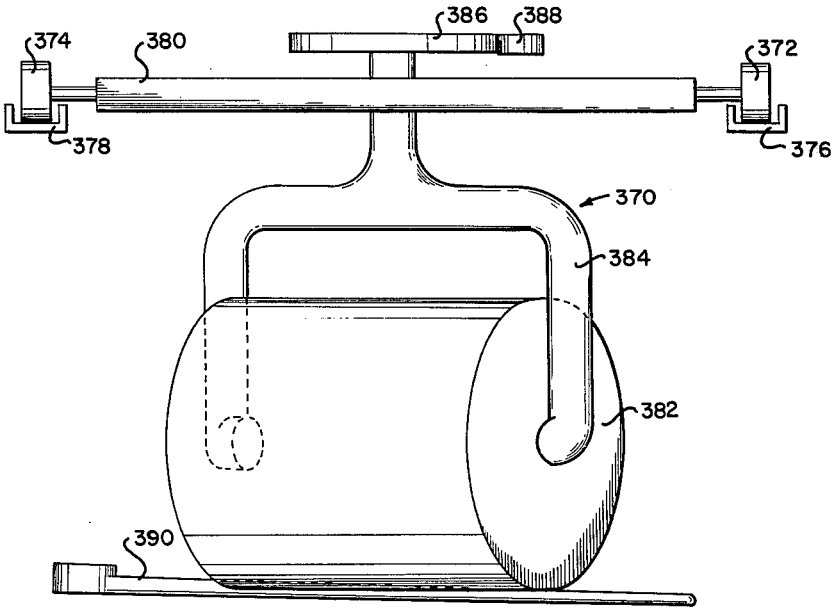
FIG.19

BIAS FABRIC

BACKGROUND OF THE INVENTION

1. Field of the Invention

The present invention relates to bias fabrics and methods and apparatus for making the same, and more particularly to fabrics comprising one or more plies of yarns oriented at a bias such as 45° relative to the direction of elongation of the fabric.

2. History of the Prior Art

Most fabrics are formed from threads or yarns which are oriented along the long axis of the fabric and at right angles relative thereto. For certain applications, however, it is desired that some or all of the yarns be at other than 0° or 90° relative to the long axis of the fabric. For example, certain fabric tapes are used in the reinforcement of aircraft wings and other aircraft structural components. To optimize strength, it is necessary that the yarns forming such tapes be oriented on the bias or at angles such as 30°, 45° or 60° relative to the long axis of the tape.

Unfortunately, conventional weaving apparatus and techniques lend themselves to 0° and 90° yarn orientation rather than bias orientation. In a conventional loom, reciprocating shuttles traverse the width of the fabric so as to interweave transverse warp yarns with longitudinal fill yarns, resulting in a conventional fabric of 0° and 90° yarn orientation. Consequently, inefficient techniques such as those involving substantial amounts of hand labor must typically be employed to make a bias fabric. For example, one common method of making fiber reinforced plastic composites of bias fiber orientation for structural applications is to start with a unidirectional tape made up of straight yarns that are parallel and adjacent to each other and that are impregnated with a resin. The tape is cut into segments of uniform length with the cuts being 45° to the long axis of the tape. Each segment is placed adjacent another segment with the original tape edge of each segment positioned next to the original tape edge of the adjoining segment. The newly formed 45° oriented tape is used as is or combined with another length of 45° tape with the yarns or fibers of the second tape 90° relative to those of the first tape. The resulting tape can then be combined with layers of pre-impregnated conventional woven fabric or with layers of unidirectional tape depending upon the needs of the designer.

One problem in working with pre-impregnated unidirectional tape is the separation of yarns within the tape during the handling operations required to make a bias tape. Separations also may occur during the layup of the oriented tape or non-uniformly tensioned yarns during subsequent manufacturing operations. This separation results in a loss of desired mechanical properties. This problem may be overcome to a substantial degree by starting with a unidirectional woven fabric instead of unidirectional tape. The fabric is comprised of straight, parallel, adjacent warp yarns secured by an adequate but minimum number of fine denier fill yarns. For example, the warp yarns may be high modulus graphite. The fill yarns may be polyester which does not contribute to the structural properties of the laminate.

While oriented tapes offer means of producing structural composites with desirable properties, they are costly because of the number of steps involved to produce the tape. To make ±45° bias tape, sufficient unidirectional fabric must be woven for the two plies of the tape. This double quantity of fabric must be pre-impregnated and then cut and laid up in two plies with the proper yarn orientation in each ply.

One technique which has been attempted involves weaving a unidirectional fabric having the desired reinforcing yarns in the filling direction, with a lightweight binding yarn in the warp direction. Fabric so woven is cut to length, then reoriented by securing one edge and advancing the other edge by the amount necessary to cause the fill yarn to lie at an angle of 45° with respect to the warp yarn. This technique solves part but not all of the problem, since it provides fabric with reinforcing yarns oriented in just one way. It is therefore necessary to use two separate layers of fabric to accomplish the need for the 90° disposition of the two layers to achieve a ±45° fabric.

Other examples of prior art fabrics and methods and apparatus for making the same are provided by French Pat. No. 1,358,056, U.S. Pat. No. 2,842,472 of Hartstein, U.S. Pat. No. 3,321,348 of Rupp, British Patent Specification No. 1,126,530, U.S. Pat. No. 3,039,169 of Frickert, Jr. and U.S. Pat. No. 4,071,647 of McMullen. These patents illustrate various different schemes for making bias fabrics in which some or all of the yarns are at 45° or in any event other than 0° and 90° with respect to the long axis of the fabric. However, such schemes for the most part do not produce fabrics of the type needed for composite reinforcing applications, and instead are more concerned with using the fabric as a reinforcement for other material to which the yarns are usually directly attached during the yarn laying process. Moreover, the methods and apparatus disclosed therein include still other disadvantages and inefficiencies in terms of ease and accuracy of producing a bias fabric. Such deficiencies and disadvantages result for the most part from the differences in emphasis and purpose of such art when compared with the typical reinforcing composite applications contemplated by the invention. Thus as noted, some of the patents listed above are concerned with laying loops of yarn or other fibrous material on another member to add bulk and strength thereto. Moreover, the apparatus shown in the patents is not capable of laying yarns in a density suited for typical applications of bias fabrics contemplated by the present invention. For example, the yarn carriers in most such arrangements are as much as 1–2″ in diameter and as such are incapable of a yarn spacing of less than about 1–1½″.

Accordingly, it is an object of the invention to provide improved bias fabrics.

It is a further object of the invention to provide improved bias fabrics of the type well suited for reinforcing applications such as in the formation of fiber reinforced plastic composites for structural applications.

It is a still further object of the invention to provide improved methods and apparatus for making bias fabrics.

BRIEF DESCRIPTION OF THE INVENTION

The above objects are accomplished in accordance with the invention by employing methods of making bias fabrics in which one or more pluralities of yarns are alternately moved back and forth between an opposite pair of movable conveyors provided with means for securing the yarns thereto. The means for securing the yarns to the conveyors may include elongated, upstanding elements such as pins, or in the alternative may comprise ring-shaped elements mounting the pins thereon and movable in different groups, or slotted guides which can be coupled for transfer with a moving yarn laying unit and mounted on the conveyor to secure the yarns thereto. A film carrying the multiple ends of yarn may be secured to the conveyors by means of conventional tenter clips or the clips may be used to secure the yarn to the conveyor without a supporting film. A yarn laying unit may be used to dispense each plurality of yarns individually or after being applied to a tape, the yarn laying unit being elongated and oriented along the long axis of the fabric to be formed and having apertures along the length thereof for receiving the yarns where the yarns are to be dispensed individually. Alternate movement of the yarn laying unit between the opposite conveyors extends the yarns between the opposite conveyors while at the same time providing for the securing of the yarns to the conveyors using the upstanding pins or equivalent arrangements.

Prior to removal of the yarns from the conveyors, the fabric formed by the yarns is stabilized to make the fabric integral and preserve its shape. Stabilization may be accomplished by a number of techniques including the knitting of one or more threads along the length of the fabric. Alternatively, lines of heated resin or adhesive can be deposited along the length of the fabric, or the fabric can be coated with resin with the resin being at least partially cured either before or after removal of the fabric from the conveyor. Where the yarns are applied to a film before formation of the fabric, stabilization is provided by various techniques including use of a film with adhesive on both sides and resin impregnation of the yarn followed by at least partial curing of the resin with the film either remaining or eliminated by use of a fugitive material therefor.

In one example according to the invention a group of yarns extending along a single yarn laying unit so as to have a length equal to twice the width of the fabric to be formed is moved laterally back and forth across the area between the conveyors as the conveyors are advanced at a controlled speed. This lays the parallel, spaced-apart yarns across the fabric at 45° angles relative to the long axis of the fabric, with each yarn being secured to the conveyor by an upstanding pin or other means before the yarns are extended across the opposite conveyor. The result is a unique diamond-shaped fabric of two ply thickness consisting of a plurality of joined triangles when viewed in plan. Within each triangle, the yarns forming the top layer of the triangle extend to form the bottom layer of a first adjacent triangle. By the same token the yarns forming the bottom layer of the triangle extend to form the top layer of a second adjacent triangle.

In a second example in accordance with the invention, two different groups of yarns, each of a width equal to the width of the fabric to be formed, are laid back and forth across the area between the opposite conveyors. Again, the yarns are oriented at an angle of 45° relative to the direction of elongation of the fabric so that the yarns of one group are laid down adjacent and in between the yarns of the other group to form a continuous, integral fabric.

In a further example according to the invention, four different groups of yarns, each having a width equal to one-half that of the fabric to be formed, are extended back and forth across the space between the opposite conveyors at angles of 45° relative to the direction of elongation of the fabric. The different groups of yarns are disposed adjacent one another to form the continuous fabric.

Disposition of each group of yarns around the upstanding pins on the conveyors is greatly facilitated by an arrangement mounted for movement with the shuttle and which includes a pair of rotatably mounted rollers extending along the length of the shuttle below the shuttle and being movable in upward and downward directions. When the shuttle reaches one of the conveyors, downward movement of the roller closest to the opposite conveyor pushes the various yarns of the group downwardly and between the upstanding pins. This greatly facilitates wrapping of the yarns around the pins as the shuttle is moved past the pins in preparation for the next movement to the opposite conveyor.

In an alternative method in accordance with the invention, one or more rapier assemblies are used to string groups of the yarns back and forth across the space between the opposite movable conveyors. Each rapier assembly is arranged to move bidirectionally along an axis forming an angle of 45° with the long axis of the fabric. Each traversal of the space between the opposite conveyors by one of the rapier assemblies is accomplished with the conveyors stationary so that the yarns dispensed by the rapier assembly are at 45° relative to the long axis of the fabric. Each time the rapier assembly reaches one of the opposite conveyors, the yarns are wrapped around two different sets of upstanding pins while at the same time the conveyors are advanced in preparation for movement of the rapier assembly back across the space between the opposite conveyors in the opposite direction. This technique results in the formation of a fabric having two different plies or layers which are unconnected. The top layer is formed by movement of a first group of yarns back and forth across the space between the conveyors. The second or bottom layer is formed by a second rapier assembly which dispenses a second group of yarns back and forth across the space between the opposite conveyors in directions forming angles of approximately 90° with the yarns in the top layer.

Where the yarns are disposed on a length of film prior to formation of the fabric, the film is repeatedly extended across the width of the fabric being formed between opposite conveyors by a yarn laying unit in the form of a track mounted frame having a roll of the film rotatably and pivotably suspended from the frame. With the roll set at an appropriate angle, the frame is moved along tracks across the width of a fabric simultaneously with advancement of the conveyors to extend the film across the width of the fabric at a desired angle. Upon reaching the fabric edge, movement is halted and the roll is pivoted relative to the frame to a complementary angle. At the same time a horizontally pivoted bar is swung over and into contact with the film to secure the film to the conveyor, and then is moved out of the way of the film. The conveyors are again advanced and the frame moved in the opposite direction along the tracks to lay the film across the width of the fabric at the desired angle.

A plurality of yarns either individually or as mounted on a film can be laid across the width of the fabric at different angles such at 30°, 45° or 60° depending on fabric requirements. The width of the intersection of each plurality of yarns with each side of the fabric is equal to the tangent of the angle of the yarns times the width of the fabric. With this information the width of the plurality of yarns can be easily determined.

BRIEF DESCRIPTION OF THE DRAWINGS

The foregoing and other objects, features and advantages of the invention will be apparent from the following more particular description of preferred embodiments of the invention, as illustrated in the accompanying drawings, in which:

FIG. 1 is a plan view of one preferred form of bias fabric in accordance with the invention;

FIG. 2 is a perspective view of apparatus used in making the bias fabric of FIG. 1;

FIG. 3 is a side view of a portion of the apparatus of FIG. 2 illustrating an arrangement for facilitating the wrapping of yarns around upstanding pins;

FIG. 5 is a plan view of a portion of a yarn laying unit and portions of transfer guides which may be used in conjunction with the apparatus of FIG. 2;

FIG. 6 is a plan view of an aperture in the yarn laying unit of FIG. 5 showing its relationship to the slots in the pair of transfer guides shown in FIG. 5;

FIGS. 7A, 7B and 7C depict three different steps in a method utilizing the transfer guides as shown in FIG. 5;

FIG. 8 is a plan view illustrating an alternative technique for making a bias fabric similar to the fabric of FIG. 1;

FIG. 11 is a top view of apparatus used in making the fabric of FIG. 10;

FIG. 12 is a side view of a portion of the apparatus of FIG. 11;

FIG. 18 is a top view of a yarn laying unit for use in laying on a film in the arrangement of FIG. 16;

FIG. 9 is a front view of the yarn laying unit of FIG. 18;

DETAILED DESCRIPTION

Figure 4:
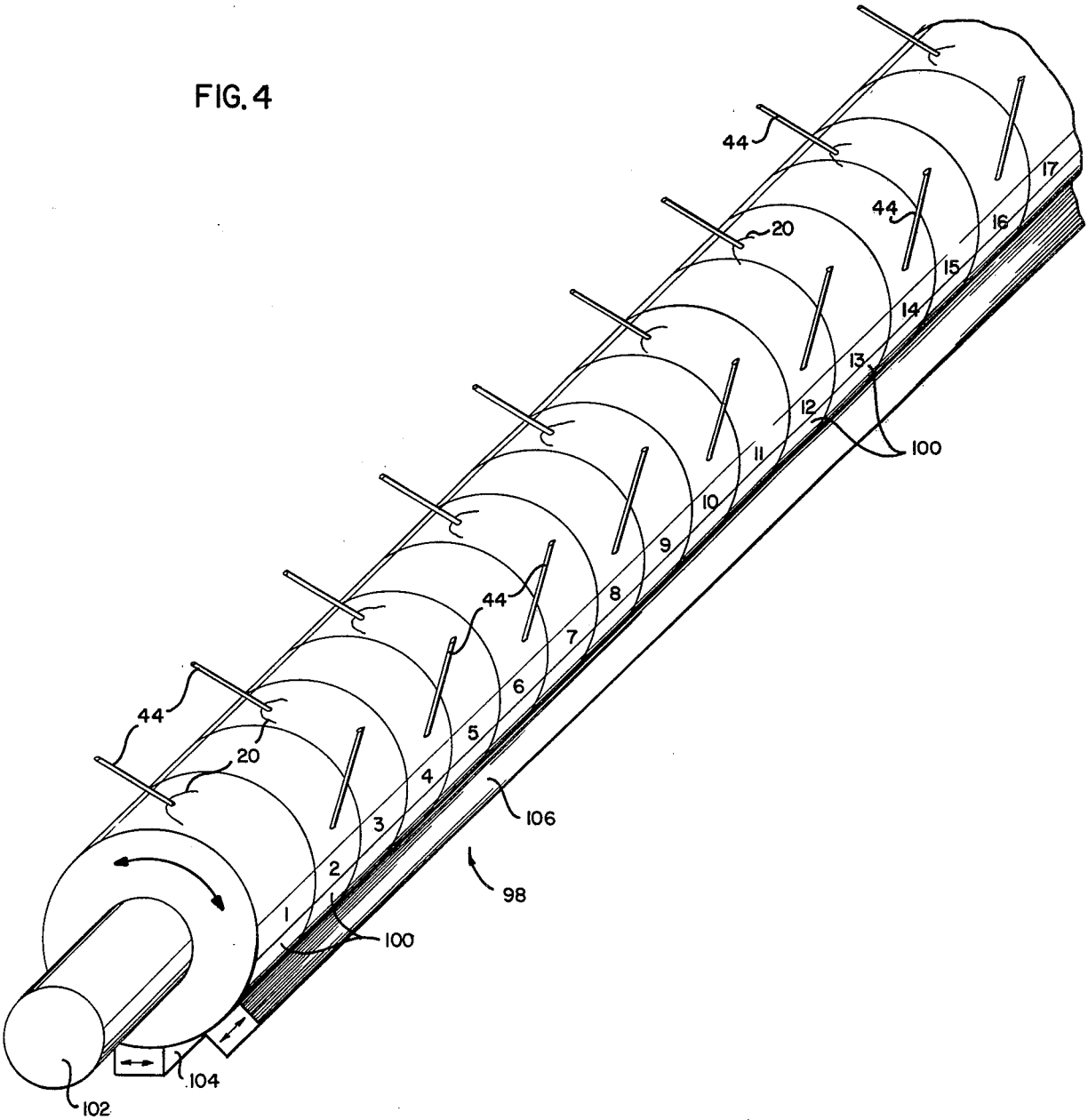
FIG. 4 is a perspective view of an alternative arrangement providing movable groups of pins on the opposite conveyors in the apparatus of FIG. 2.

FIG. 1 depicts a bias fabric 10 in accordance with the invention. The fabric 10 of FIG. 1 has a diamond-shaped pattern in that in the plan view thereof shown in FIG. 1 it consists of a series of triangular portions 12. Each of the triangular portions 12 extends from one edge 14 of the fabric 10 to an opposite edge 16 of the fabric. Each triangular portion 12 consists of two different layers of yarns which are at 90° relative to each other and 45° relative to the long axis of the fabric 10. Accordingly, the fabric 10 comprise a ±45° bias fabric. The yarns within each layer are generally parallel and spaced-apart and form a generally planar yarn layer.

In the view comprised by FIG. 1, the yarns of the top layer of each triangular portion 12 are illustrated as solid lines and the yarns of the bottom layer are illustrated as dashed lines. It will be observed that the yarns forming the top layer of one of the triangular portions 12 extend into and form the bottom layer of an adjacent one of the triangular portions 12. Conversely, the yarns forming the bottom layer of a given triangular portion 12 extend into and form the top layer of a different adjacent triangular portion 12.

The bias fabric 10 shown in FIG. 1 is formed by alternately extending a group of yarns back and forth across the width of the fabric 10 between the opposite edges 14 and 16. Because the various yarns are at angles of 45° relative to the edges 14 and 16 and the long axis of the fabric, the group of yarns must have a width measured along either edge 14 and 16 which is twice the width of the fabric 10. Thus, as shown in FIG. 1 the fabric 10 is formed by a group 18 of yarns 20 which are extended back and forth across the fabric 10 between the opposite edges 14 and 16. The yarn group 18 is shown as having a length of 2W along the edge 16 where W is the width of the fabric 10.

FIG. 2 illustrates apparatus 24 for making the bias fabric 10 of FIG. 1. The apparatus 24 includes an opposite pair of conveyors 26 and 28 which are disposed generally parallel to each other. The conveyors 26 and 28 which are in the shape of endless belts are made movable by being mounted so as to extend around opposite pulleys 30, 32, 34 and 36. The pulleys 30 and 34 are mounted on a common shaft 38, while the pulleys 32 and 36 are mounted on a common shaft 40. Each of the conveyors 26 and 28 is broken into segments 42 which are of equal length and which are hinged together to make the conveyors 26 and 28 flexible as they move around the pulleys 30, 32, 34 and 36. The conveyor 26 has a plurality of elongated upstanding pins 44 mounted along the length thereof in a generally linear configuration. In like fashion the conveyor 28 has a plurality of pins 46 mounted along the length thereof.

The apparatus 24 of FIG. 2 includes a stationary yarn guide 48 mounted above and between the conveyors 26 and 28. The guide 48 has a plurality of apertures 50 along the length thereof with each receiving a different one of the yarns 20. The yarns 20 emanate from a suitable source such as creels 52 mounted above the stationary yarn guide 48. The yarns 20 extend downwardly from the creels 52 through the apertures 50 in the yarn guide 48 and then to a yarn laying unit 54. The yarns 20 can be supplied to the yarn laying unit 54 by arrangements other than the creels 52 and the yarn guide 48 such as a warp beam in the form of a cylindrical roller which is mounted for reciprocating movement across the space between the conveyors 26 and 28 and which has each of the different yarns 20 wound around a different portion of the length thereof.

The yarn laying unit 54 which is configured somewhat similarly to the yarn guide 48 has a plurality of apertures 56 along the length thereof for receiving the yarns 20. Whereas the yarn guide 48 is stationary, the yarn laying unit 54 which also extends in the direction of the long axis of the bias fabric to be formed so as to be parallel to the opposite conveyors 26 and 28 is movable laterally back and forth between the conveyors 26 and 28. Lateral movement of the yarn laying unit 54 is provided by a pair of tracks 58 and 60 extending transversely across the width of the apparatus 24 at the opposite ends of the yarn laying unit 54 and being rigidly mounted. Support rods 62 and 64 extend from opposite ends of the yarn laying unit 54 and are slidably mounted on the tracks 58 and 60 respectively. The outer ends of the support rods 62 and 64 are respectively coupled by connecting rods 66 and 68 to drive wheels 70 and 72 which are mounted on a common shaft hidden by the conveyor 28 in FIG. 2. Rotation of the wheels 70 and 72 reciprocates the connecting rods 66 and 68 and thus the support rods 62 and 64 and included yarn laying unit 54 along the tracks 58 and 60. The wheels 70 and 72 can be driven independently, but preferably are synchronized to the operation of the conveyors 26 and 28 by being coupled to one of the shafts 38 and 40 by one arrangement of shafts and bevel gears omitted from FIG. 2 for simplicity of illustration.

The apparatus 24 of FIG. 2 makes the bias fabric 10 shown in FIG. 1 by moving the yarn laying unit 54 back and forth between the conveyors 26 and 28 at the controlled speed as the conveyors 26 and 28 are advanced by the pulleys 30, 32, 34 and 36 at a controlled speed. In this manner the various yarns 20 are extended across the space between the conveyors 26 and 28 so as to form angles of 45° with the conveyors 26 and 28 and the long axis of the fabric being so formed. As the yarn laying unit 54 reaches each of the conveyors 26, 28, the various yarns 20 are wrapped around the pins 44 and 46 on the conveyors so that each yarn 20 wraps around a different pin. As the conveyors 26 and 28 continue to advance, the yarn laying unit 54 begins its return across the space between the conveyors to the opposite conveyor where the yarns are wrapped around the pins on the opposite conveyor. Referring again to FIG. 1, the yarn group 18 is shown as having just been pulled across the width of the fabric 10 to the edge 16 which corresponds to the conveyor 26 in the apparatus 24 of FIG. 2. An arrow 73 shown in FIG. 1 illustrates the direction of movement of the conveyors 26 and 28 and the fabric 10 being formed thereon. With the yarn group 18 in the position shown in FIG. 1, the individual yarns 20 are wrapped around the various pins 44 on the conveyor 26 prior to the return of the yarns to the opposite edge 14 of the fabric 10.

Laying of the individual yarns 20 between the pins 44 and 46 so as to facilitate wrapping of the yarns around the pins is facilitated by an arrangement which is coupled to the yarn laying unit 54 for movement therewith and which is shown in detail in FIG. 3. Such arrangement includes an opposite pair of rollers 74 and 76 extending along the length of the yarn laying unit 54 and disposed on opposite sides of the yarn laying unit 54. The rollers 74 and 76 are rotatably mounted at their opposite ends by elongated mounting arms 78 and 80. Each of the arms 78 and 80 rotatably mounts the rollers 74 and 76 at the opposite ends thereof. The arms 78 and 80 are pivotably mounted at the center thereof on the support rods 62 and 64 respectively. Tripping blocks 82 and 84 extend upwardly from the yarn laying unit 54 at the opposite ends thereof adjacent the support rods 62 and 64 respectively to control the angular positions of the mounting arms 78 and 80. The tripping block 82 is disposed between an opposite pair of fixedly mounted knockers 86 and 88 disposed above and adjacent the conveyors 26 and 28 respectively. The tripping block 84 is disposed between an opposite pair of fixedly mounted knockers 90 and 92 disposed about and adjacent the conveyors 26 and 28 respectively.

Each time the yarn laying unit 54 is moved over one of the conveyors 26 and 28, the tripping blocks 82 and 84 strike the knockers 86 and 90 or 88 and 92 so as to pivot and lower the inside roller, thereby forcing the yarns 20 down between the pins. In the example of FIG. 3, the yarn laying unit 54 is assumed to have just migrated from the conveyor 26 over and past the conveyor 28. The tripping blocks 82 and 84 strike the knockers 88 and 92 so as to pivot the arms 78 and 80 to lower the roller 74 into a lowered position shown in dotted outline in FIG. 3. This forces the yarns 20 downwardly between the pins 46 into a position shown in dotted outline in FIG. 3. As the conveyors 26 and 28 continue to advance relative to the yarn laying unit 54 so as to wrap the yarns 20 around the pins 46, return of the yarn laying unit 54 toward the conveyor 26 is begun. At that point the arms 78 and 80 return to the horizontal position so that the rollers 74 and 76 pass freely over the pins 46. When the yarn laying unit 54 reaches and passes over the opposite conveyor 26, the tripping blocks 82 and 84 engage the knockers 86 and 90 to lower the roller 76 to dispose the yarns 20 between the pins 44. As the yarn laying unit 54 begins its return over the conveyor 26 and toward the conveyor 28 the roller 76 is returned to the neutral position having accomplished the job of aiding in wrapping the yarns 20 around the pins 44.

The yarn spacing specification is normally expressed as the number of ends per inch per single layer measured at an angle of 45° to the center line of the fabric. With the yarn measured along the long axis of the fabric, the spacing between the conveyor pins 44 and 46 is N sin 45° where N is the number of ends per inch. For example, the number of ends per inch desired may be 12 or 24. For 12 ends per inch, the pin spacing must be $0.707 \times 12$ or 8.48 per inch, with a spacing of 1/8.48 or 0.118 inches between pin centers. At 24 yarns per inch, the lineal spacing of pins is about 17 per inch or 0.059 inches between pin centers. High density conditions such as 24 yarns per inch may require the use of pins of less than desirable diameters and may require a higher than desirable degree of precision in the yarn laying operation. These difficulties may be overcome by the use of two yarn laying units or shuttles, each carrying one-half the total number of yarns. This can be accomplished using a special pin carrying arrangement 98 shown in FIG. 4.

Arrangements like the arrangement 98 shown in FIG. 4 are placed on each of the carriers 26 and 28 for movement therewith. The arrangement 98 includes a plurality of ringshaped pin mounting elements 100 rotatably mounted on a common shaft 102. The arrangement 98 shown in FIG. 4 is assumed to reside on the conveyor 26 so that a different one of the pins 44 is mounted on each of the mounting elements 100.

A first elongated boss 104 extends along the length of the arrangement 98 and is coupled to alternate ones of the mounting elements 100 including the first, the third, the fifth and so on. A second elongated boss 106 is coupled to each of the intervening or even numbered mounting elements 100 including the second, the fourth, the sixth and so on. Movement of the bosses 104 and 106 relative to the shaft 102 rotates the various mounting elements 100 which are coupled thereto so as to position the various pins 44 in different locations. As shown in FIG. 4 the pins 44 mounted on the odd numbered mounting elements 100 are aligned along the axis of the shaft 102 while at the same time being spaced apart from the pins 44 on the even numbered mounting elements 100. Removal of alternate pins from the vicinity of the remaining pins doubles the space between adjacent pins and thereby greatly facilitates wrapping of the yarns around the pins in high density applications. Thus the pins 44 on the odd numbered mounting elements 100 are shown in FIG. 4 as positioned to receive the various yarns 20 with the pins 44 on the even numbered mounting elements 100 being in a different location so as to minimize interference. Following installation of the yarns 20 over the pins 44 on the odd numbered mounting elements 100, the bosses 104 and 106 are repositioned so as to reverse the positions of the pins on the odd and even numbered mounting elements. As previously noted the arrangement 98 of FIG. 4 is used in conjunction with two yarn laying units respectively carrying the odd and even numbered yarns of the yarn group 18. The odd and even numbered yarns are respectively wound around pins on the odd and even numbered mounting elements 100 in the pin carrying arrangement 98. The two yarn laying units can be arranged so that one follows the other across the space between the opposite conveyors 26 and 28. Alternatively, one yarn laying unit can be located upstream or downstream from the other yarn laying unit along the long axis of the fabric with the yarn laying units being moved back and forth together.

Since the pin carrying arrangement 98 of FIG. 4 does not bend so as to be able to follow the conveyor 26 or 28 on which it is mounted around the pulleys 30, 32, 34 and 36, the arrangement 98 is designed to be positioned on a top portion of the conveyor and to separate from and move forward from the conveyor as it winds downwardly over the pulley. The arrangement 98 is preferably made in sections of chosen standard length so that other arrangements 98 can be placed on the conveyors 26 and 28 immediately behind those arrangements previously positioned on the conveyors 26 and 28.

Certain types of yarns used to make the bias fabric can be damaged when subjected to short radius bending under relatively high tension. Such yarns may require the use of arrangements other than the pins 44 and 46 shown in FIGS. 2–4. One such alternative arrangement is shown in FIGS. 5, 6 and 7A–7C. Referring to FIG. 5 there is shown therein the yarn laying unit 54 together with a pair of transfer guides 108 and 110. The yarn laying unit 54 has a plurality of elongated apertures 112 spaced along the length thereof for receiving different ones of the yarns 20. The transfer guide 108 has a plurality of slots 114 in an edge 116 thereof closest the yarn laying unit 54. The transfer guide 110 has a plurality of slots 118 in an edge 120 thereof closest the yarn laying unit 54. The spacing between the slots 114 is identical to the spacing between the elongated apertures 112. Likewise, the spacing between the slots 118 is identical to the spacing between the elongated apertures 112.

FIG. 6 depicts the relative sizes and positions of the apertures 112 and the slots 114 and 118 with the guide 108 positioned under the lefthand portion of the yarn laying unit 54 and the guide 110 positioned under the righthand half of the yarn laying unit 54. It will be seen that the apertures 112 and the slots 114 and 118 have the same width. However, whereas the opposite ends of each aperture 112 are rounded, the inner portion of each slot 114 and 118 is angled down to a small corner. In the example of FIGS. 5 and 6 the yarns 20 are assumed to be untwisted so as to assume a ribbon shape which is accommodated by the elongated apertures 112. The narrow corner of each slot 114 and 118 is configured to trap and secure the ribbon shaped yarn therein as described hereafter in connection with FIGS. 7A–7C.

The transfer guide 108 is provided with a plurality of pegs 122 extending through the thickness thereof so as to protrude from both the top and bottom surfaces thereof. Likewise, the transfer guide 110 is provided with a plurality of pegs 124. The portion of the peg 122 extending above the top surface of the transfer guide 108 is adapted to be inserted within an aperture 126 in the bottom of the yarn laying unit 54. Likewise the portion of the peg 124 extending above the top surface of the transfer guide 110 is adapted to be inserted within an aperture 128 in the bottom of the yarn laying unit 54. The pegs 122 and 124 serve to temporarily fasten the transfer guides 108 and 110 to the underside of the yarn laying unit 54 as described in greater detail in connection with FIGS. 7A–7C.

The manner in which transfer guides such as the guides 108 and 110 of FIG. 5 are used to secure the various yarns 20 to the conveyors 26 and 28 in place of the pins 44 and 46 is illustrated in connection with FIGS. 7A–7C. In FIG. 7A it is assumed that the yarn laying unit 54 has just moved to the left from the conveyor 28 to the conveyor 26 with the transfer guide 110 mounted at the underside of the righthand portion thereof via the pegs 124. The various yarns 20 extend under the transfer guide 110, up through the slots 118 and through the elongated apertures 112. As the yarn laying unit 54 reaches the conveyor 26 a pivotably mounted element 130 shown in dotted outline in FIG. 7A and which is rotatably mounted about a fixed pivot point 132 has a lower end 134 thereof engaged by the yarn laying unit 54. This causes downward movement of an opposite end 136 of the element 130 to separate the transfer guide 110 from the yarn laying unit 54 while at the same time forcing the lower portions of the pegs 124 into apertures within the top surface of the conveyor 26. This mounts the transfer guide 110 on the conveyor 26 so as to secure the various yarns 20 in place thereon.

At the same time that the transfer guide 110 is released from the yarn laying unit 54 and mounted on the conveyor 26, the transfer guide 108 is mounted on the underside of the yarn laying unit 54 by inserting the top portions of the pegs 122 into the apertures 126 at the underside of the yarn laying unit 54. As the yarn laying unit 54 is then moved to the right from the conveyor 26 to the conveyor 28, the yarns 20 are pulled downwardly through the elongated apertures 112 in the yarn laying unit 54 and through the slots 114 in the transfer guide 108.

When movement of the yarn laying unit 54 from the conveyor 26 to the conveyor 28 is completed, a pivotably mounted element similar to the element 130 shown in FIG. 7A is engaged by the yarn laying unit 54 to separate the transfer guide 108 from the yarn laying unit 54 and mount the guide 108 on top of the conveyor 28. At the same time a new transfer guide 138 identical to the guide 110 is installed at the bottom side of the right-hand portion of the yarn laying unit 54 as seen in FIG. 7B.

When the yarn laying unit 54 is next moved from the conveyor 28 back to the conveyor 26, the pivotably mounted element 130 releases the transfer guide 138 from the yarn laying unit 54 and mounts the guide 138 on the conveyor 26 as shown in FIG. 7C. At the same time a new transfer guide 140 which is identical to the guide 108 is installed at the bottom of the yarn laying unit 54.

The procedure described in FIGS. 7A–7C is repeated with new transfer guides being constantly added to the yarn laying unit 54 with each traverse thereof. The various transfer guides may be made of flexible material so as to flex with the supporting conveyors 26 and 28 as the conveyors roll over the wheels 30 and 34. Alternatively, the transfer guides may be made of rigid material which is removed from the conveyors 26 and 28 much in the same way as the pin carrying arrangements 98 of FIG. 4.

FIG. 8 shows an alternative bias fabric 144 which is similar to the bias fabric 10 of FIG. 1 except that it is made using two different groups of yarns. The fabric 144 of FIG. 8 is made using a first group of yarns 146 and a second group of yarns 148. The first group of yarns 146 forms a first yarn layer 150 and the second group of yarns 148 forms a second yarn layer 152. In the example of FIG. 8 the fabric 144 is assumed to advance in the direction shown by an arrow 154. The fabric 144 has a right side 156 and a left side 158 as seen in FIG. 8. The generally uniform width W of the fabric 144 between the generally parallel opposite sides 156 and 158 is equal to the width W of the fabric 10 in FIG. 1. However, whereas the fabric 10 of FIG. 1 is made using a single group of yarns 18 having a length of 2W along either of the opposite edges 14 and 16, the fabric 144 of FIG. 8 is made using the two yarn groups 146 and 148, each of which has a length W along either of the sides 156 and 158 equal to the width W of the fabric 144. This is required by the fact that the various yarns of the groups 148 and 150 form angles of 45° with the long axis of the fabric 144 and to the fact that the yarn groups 148 and 150 alternate as they are extended back and forth across the width of the fabric.

The two different yarn groups 146 and 148 are installed using an arrangement like that of FIG. 2 except that two different yarn laying units each having a useful length W are used. As viewed in FIG. 8 one of the two yarn laying units has just traversed from the right side 156 to the left side 158 of the fabric 144 with the second yarn group 148. At this point the various yarns of the yarn group 148 are secured around the pins or equivalent elements on the conveyor at the side 158. At the same time, the other yarn laying unit has just traversed from the left side 158 to the right side 156 of the fabric 144 carrying the first group of yarns 146 which are then positioned around the pins or equivalent elements on the conveyor at the right side 156. As the process continues, the first group of yarns 146 is extended across the fabric 144 from right to left as seen in FIG. 8 while the second group of yarns 148 is extended across the fabric from left to right as seen in FIG. 8.

Figure 9:
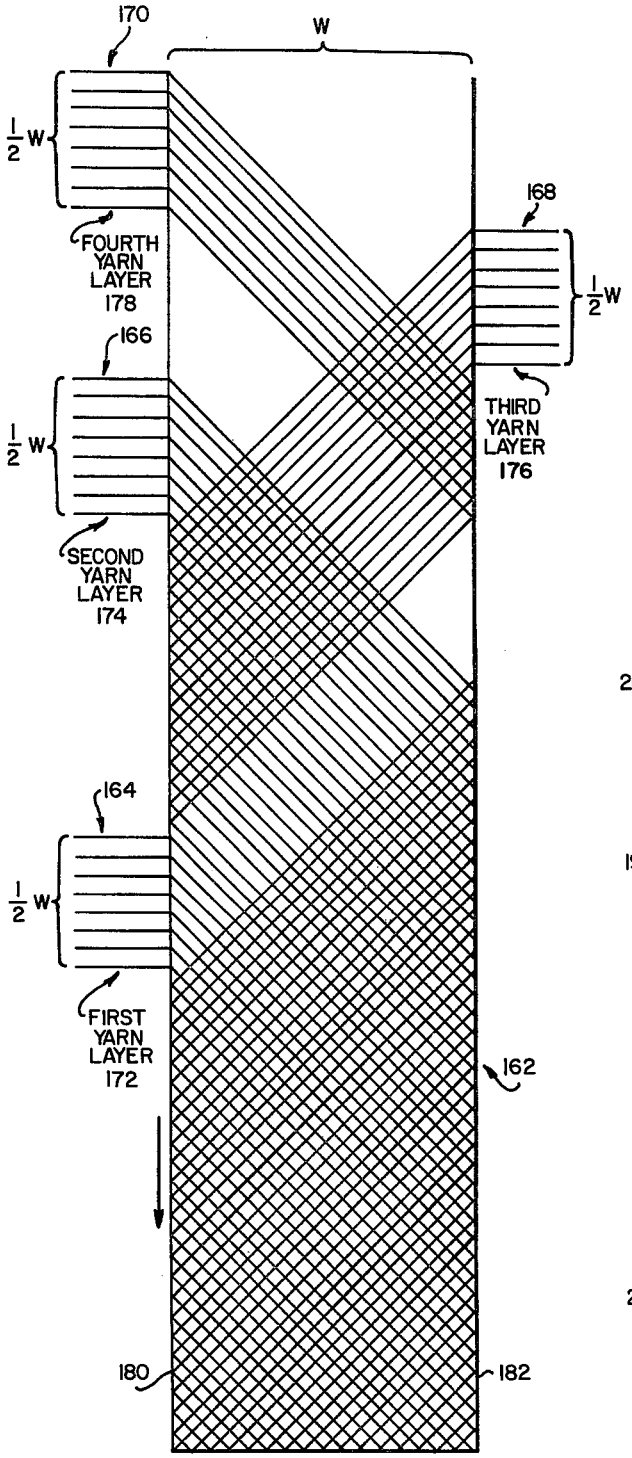
FIG. 9 is a plan view of a further alternative technique for making a bias fabric similar to the fabric of FIG. 1.

FIG. 9 depicts still another technique for making a bias fabric similar to the bias fabric 10 of FIG. 1. The bias fabric 162 shown in FIG. 9 is made using four different yarn groups 164, 166, 168 and 170. Each of the yarn groups 164, 166, 168 and 170 is comprised of a plurality of generally parallel, spaced-apart yarns arranged in a generally planar configuration and forming a first yarn layer 172, a second yarn layer 174, a third yarn layer 176 and a fourth yarn layer 178 respectively. Each of the yarn layers 172, 174, 176 and 178 has a width along a left edge 180 or a right edge 182 of the bias fabric 162 which is one-half the width W of the fabric 162.

The different yarn groups 164, 166, 168 and 170 are extended in succession back and forth across the width W of the fabric 162 being formed thereby. Since the fabric 162 is of width W and each of the yarn groups 164, 166, 168 and 170 has a length along the axis of the fabric 162 of one-half W, all of the yarns in the various groups form angles of 45° with the edges 180 and 182 and the long axis of the fabric 162. The different yarn groups 164, 166, 168 and 170 are extended across the width of the fabric and around conveyor pins at the opposite edges 180 and 182 by four different yarn laying units which operate in similar fashion to the yarn laying unit 54 shown in FIG. 2. The four different yarn laying units operate independently of each other, each with its own drive, but normally all four will operate simultaneously. In the particular example of FIG. 9, the first yarn laying unit has just moved the first yarn group 164 across the fabric 162 to the left edge 180 so that the yarns of the first group 164 are being wrapped around pins or equivalent securing means at the left edge 180. Similarly, second and fourth yarn laying units have just taken the second yarn group 166 and the fourth yarn group 170 respectively across the fabric width from the right edge 182 to the left edge 180 where the yarns of the groups 166 and 170 are wrapped around pins or equivalent yarn securing means. A third yarn laying unit has just taken the third yarn group 168 across the width of the fabric 162 from the left edge 180 to the right edge 182 where the yarns of the third group 168 are wrapped around pins or equivalent yarn securing means.

Figure 10:
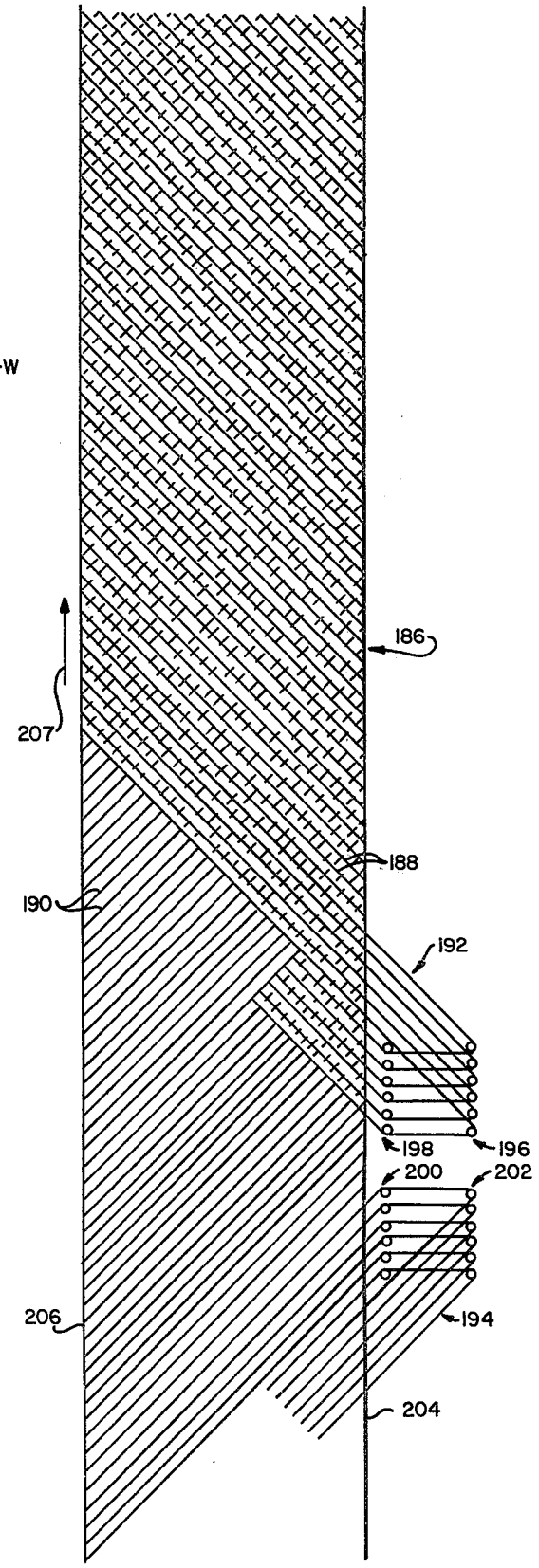
FIG. 10 is a plan view of an alternative arrangement of a bias fabric in accordance with the invention.

FIG. 10 depicts an alternative arrangement of a ±45° bias fabric 186 in accordance with the invention. The fabric 186 is comprised of a top ply or layer 188 and a bottom ply or layer 190. The top ply 188 is formed from a single group of yarns 192 which, in the present example, consists of six yarns. Whereas the yarn groups in the fabrics of FIGS. 1, 8 and 9 extend across the fabric in zig-zag fashion so as to alternately form angles of +45° and −45° with the long axis of the fabric, in the case of the fabric 186 of FIG. 10 each yarn group such as the group 192 always extends across the fabric width with the same orientation so as to form the same angle of either +45° or −45° with the long axis of the fabric 186. Thus, all of the yarns in the top ply 188 formed by the yarn group 192 extend in the same direction. The yarns in the bottom ply 190 which are formed by a group of yarns 194 also extend in the same direction and form right angles or angles of 90° with the yarns in the top ply 188.

FIG. 10 depicts a small portion of one particular pin arrangement which can be used in conjunction with the yarn groups 192 and 194 to form the bias fabric 186. Depicted in FIG. 10 is a first pinset 196, a second pinset 198, a third pinset 200 and a fourth pinset 202. Each of the pinsets 196, 198, 200 and 202 has a like number of pins therein which is equal to the number of yarns in the groups 192 and 194 and is therefore six in the present example. The pinsets 196, 198, 200 and 202 are mounted on a conveyor at the right edge 204 of the fabric 186 being formed. The pinsets 198 and 200 are mounted on the conveyor parallel to and slightly spaced-apart from the right edge 204. The pinsets 196 and 202 are also parallel to the right edge 204 and are disposed opposite the pinsets 198 and 200 from the right edge 204. For simplicity of illustration, only four pinsets are shown in FIG. 10. In actual practice pinsets are spaced along the entire length of the conveyor at the right edge 204 as well as along the length of the conveyor at an opposite left edge 206.

In the example of FIG. 10 the bottom ply or layer 190 is formed before the top ply 188 by extending the yarn group 194 back and forth across the width of the fabric 186. As seen in FIG. 10 the yarn group 194 has just traversed the width of the fabric 186 and a reversal in direction thereof is provided by the pinsets 200 and 202. The individual yarns of the yarn group 194 extend around different ones of the pins in the pinset 200 and are then directed to different ones of the pins in the pinset 202. From the pinset 202 the yarns of the group 194 extend back across the width of the fabric 186. The pinsets 200 and 202 therefore serve to displace the yarn group 194 from the prior pass of the yarn group 194 across the fabric width by the width of the six yarn groups. Like groups of pins at the opposite left edge 206 of the fabric 186 are used to secure and then return the yarn group 194 back from the left edge 206 to the right edge 204 of the fabric.

The opposite conveyors mounting the pinsets such as the sets 196, 198, 200 and 202 move in a direction shown by an arrow 207. Just downstream of the yarn group 194, the yarn group 192 is used to form the top ply or layer 188. As shown in FIG. 10 the yarn group 192 has just traversed the width of the fabric 186 from the left edge 206 to the right edge 204. The individual ones of the yarns within the group 192 extend around different ones of the pins in the first pinset 196 before extending to and around different pins in the second pinset 198. From the pinset 198 the yarns of the first group 192 extend back across the width of the fabric 186 from the right edge 204 to the left edge 206. The different pinsets on the opposite conveyors are shared by both groups of yarns 192 and 194. Thus, while it is not shown in FIG. 10 the pinsets 196 and 198 being used by the first yarn group 192 have already been used by the second yarn group 194 in the formation of the bottom ply or layer 190. The yarns of the first group 192 simply lie on top of those of the second group 194.

FIG. 11 depicts one arrangement of apparatus 210 for making the bias fabric 186 of FIG. 10. The apparatus 210 includes a conveyor 212 forming the right edge 204 of the fabric 186 and a conveyor 214 forming the left edge 206 of the fabric 186. The pinsets 196 and 198 are shown mounted on the conveyor 212. The conveyors 212 and 214 move in the directions shown by arrows 216 and 218 respectively. A first rapier assembly 220 is movable back and forth across the space between the conveyors 212 and 214 along an axis shown by an arrow 222. Six different guides 224 are mounted on the rapier assembly 220 so as to dispense the six different yarns of the yarn group 194. Yarns for the guides 224 are provided by creels mounted to the left of the conveyor 214 and not shown in FIG. 11. The yarns of the yarn group 194 extend downwardly through apertures 226 adjacent an outer end 228 of the first rapier assembly 220. From the apertures 226 the first group of yarns 194 is dispensed so as to be laid across the space between and around the pinsets on the opposite conveyors 212 and 214.

The apparatus 210 of FIG. 11 also includes a second rapier assembly 230 which is movable bidirectionally along an axis shown by an arrow 232 and which has a plurality of creel fed guides 234 mounted thereon for dispensing the yarns comprising the first yarn group 192. The yarns in the first yarn group 192 extend downwardly through a plurality of apertures 236 at an outer end 238 of the rapier assembly 230.

The manner in which the yarns at the ends of the rapier assemblies 220 and 230 are wrapped around the pins of the pinsets is illustrated in FIG. 12. FIG. 12 depicts the outer end 238 of the rapier assembly 230 which dispenses the first group of yarns 192 through the apertures 236. Each of the apertures 236 is aligned with a different one of a plurality of hollow tubes 240 extending downwardly from the underside of the rapier assembly 230. In FIG. 12 the rapier assembly 230 is assumed to have moved to its extreme position over the conveyor 212 with the conveyors 212 and 214 at rest. This action moves the hollow tubes 240 between the individual pins 242 of the first pinset 196 so as to begin to wrap the yarns of the group of yarns 192 around the pins 242. With the rapier assembly 230 in the position shown in FIG. 12, the outer end 238 of the rapier assembly 230 is moved at a right angle relative to the long axis of the conveyor 212 to complete wrapping of the yarns around the pins 242 of the first pinset 196 and to extend the yarns to and around the second pinset 198. This is accomplished by moving the rapier assembly 230 at a controlled speed from right to left as viewed in FIG. 11 while at the same time advancing the conveyors 212 and 214 at a controlled speed in the direction of the arrows 216 and 218. When the yarns have been wrapped around the second pinset 198, the conveyors 212 and 214 are halted and continued movement of the rapier assembly 230 along the axis 232 lays in the next pass of the yarn group 192 across the space between the conveyors 212 and 214. When the rapier assembly 230 reaches the opposite conveyor 214 so as to wrap the yarns of the first yarn set 192 partially around a first set of pins, the conveyors 212 and 214 are again advanced at a controlled speed simultaneously with continued movement of the rapier assembly 230 so as to extend the yarns at right angles relative to the long axis of the conveyor 214 to and around a second set of pins on the conveyor 214. At this point the conveyors 212 and 214 are stopped and the direction of the rapier assembly 230 is reversed to return the rapier assembly from the conveyor 214 to the conveyor 212.

The rapier assembly 220 operates in a similar manner to the rapier assembly 230 to dispense the yarns of the second yarn group 194 around the various pinsets. Operation of the rapier assemblies 220 and 230 is preferably synchronized so that they reciprocate back and forth between the conveyors at the same rate and in the same direction. In this manner movement of the conveyors 212 and 214 simultaneously with the rapier assemblies 220 and 230 enables the rapier assemblies to move the yarns thereof between the opposite pinsets simultaneously.

Figure 13:
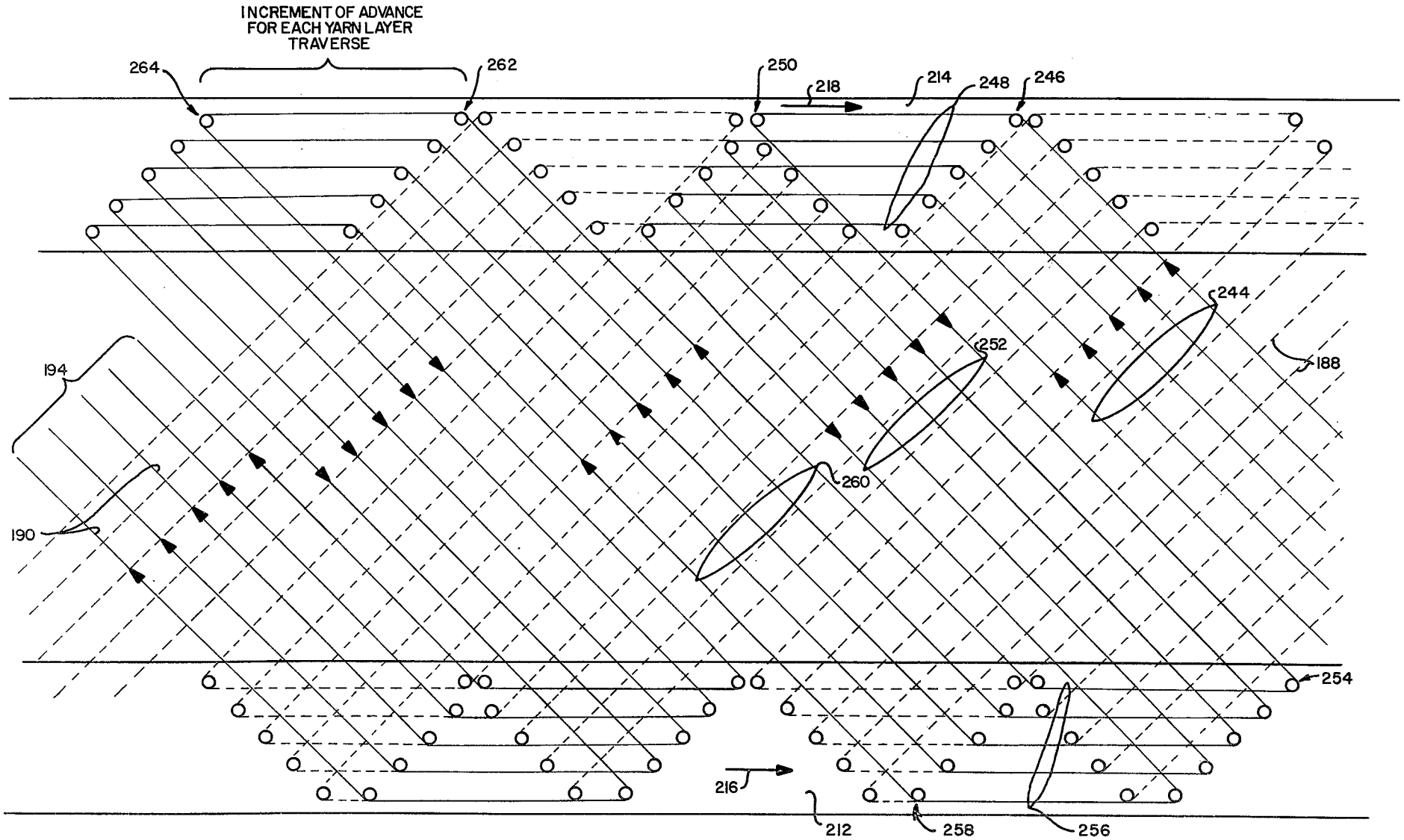
FIG. 13 is a plan view of a portion of the apparatus of FIG. 11 illustrating one technique for making the fabric of FIG. 10.

FIG. 13 depicts an alternate technique for making the fabric 186 of FIG. 10. FIG. 13 depicts the conveyors 212 and 214 which are movable in the direction of the arrows 216 and 218. The rapier assembly 220 which is not shown in FIG. 13 is used to lay in the yarns of the second yarn group 194 to form the bottom ply or layer 190 which is shown in FIG. 13. The top ply or layer 188 which is shown in dashed outline in FIG. 13 is subsequently formed in the same way as the bottom ply or layer 190 using the other rapier assembly 230 so as to be oriented 90° relative to the yarns of the bottom ply or layer 190.

The arrangement of FIG. 13 differs from that of FIG. 11 in that the yarn group 194 comprises five yarns instead of six and further in that the conveyors 212 and 214 are provided with sets of five pins which, although each set is linearly arranged, zig-zag back and forth across the width of each conveyor rather than being parallel to the long axis of the conveyor.

Fabric formation utilizing the arrangement of FIG. 13 can be better understood by considering several passes of the rapier assembly 220 back and forth between the opposite conveyors 212 and 214. In a first such pass designated 244 the yarns are extended from the conveyor 212 to a set of pins 246 on the conveyor 214. As the rapier assembly 220 moves across from the conveyor 212 to the set of pins 246, the conveyors 212 and 214 remain stationary. However, as the rapier assembly reaches the set of pins 246 movement of the conveyors 212 and 214 is begun. This causes the yarns to move parallel to the direction of elongation of the conveyor 214 to form a pass along the length of the conveyor 214 designated by the reference numeral 248. When the yarns reach a set of pins 250 parallel to but spaced apart from the pinset 246 along the length of the conveyor 214, the conveyors 212 and 214 are stopped and the direction of movement of the rapier assembly 220 is reversed to initiate a pass 252 of the yarns from the conveyor 214 to the conveyor 212.

When the yarns reach a pinset 254 on the conveyor 212, the direction of movement of the rapier assembly 220 is reversed and at the same time movement of the conveyors 212 and 214 is begun. This results in a pass along the length of the conveyor 212 as shown by a reference numeral 256. When the yarns reach a pinset 258 parallel to and spaced apart from the pinset 254, movement of the conveyors 212 and 214 is halted as the rapier assembly 220 continues to move in the direction from the conveyor 212 to the conveyor 214. This results in a pass 260 of the yarns across the space between the conveyor 212 and the conveyor 214. When the yarns reach the conveyor 214, they are wrapped around a pinset 262 and then eventually a pinset 264 as the conveyor 214 is advanced simultaneously with the rapier assembly.

Formation of the top ply or layer 188 takes place in the same manner as just described using the rapier assembly 230. The five yarns of the yarn group 192 forming the top ply or layer 188 are shown dashed in FIG. 13.

The various bias fabrics described thus far are stabilized while still on the conveyor to make them integral so that the yarns do not fall apart. The manner in which the fabric is stabilized depends on a number of things including the ultimate use of the fabric. For some applications it may be desirable or necessary that the fabric be free of any stabilizing materials after transfer to a location where it will maintain its integrity. In other cases, the presence of stabilized materials is no problem and may even be desirable. In still other cases the stabilization process becomes part of further processing of the fabric such as resin impregnation with some coring as described hereafter.

Figure 14:
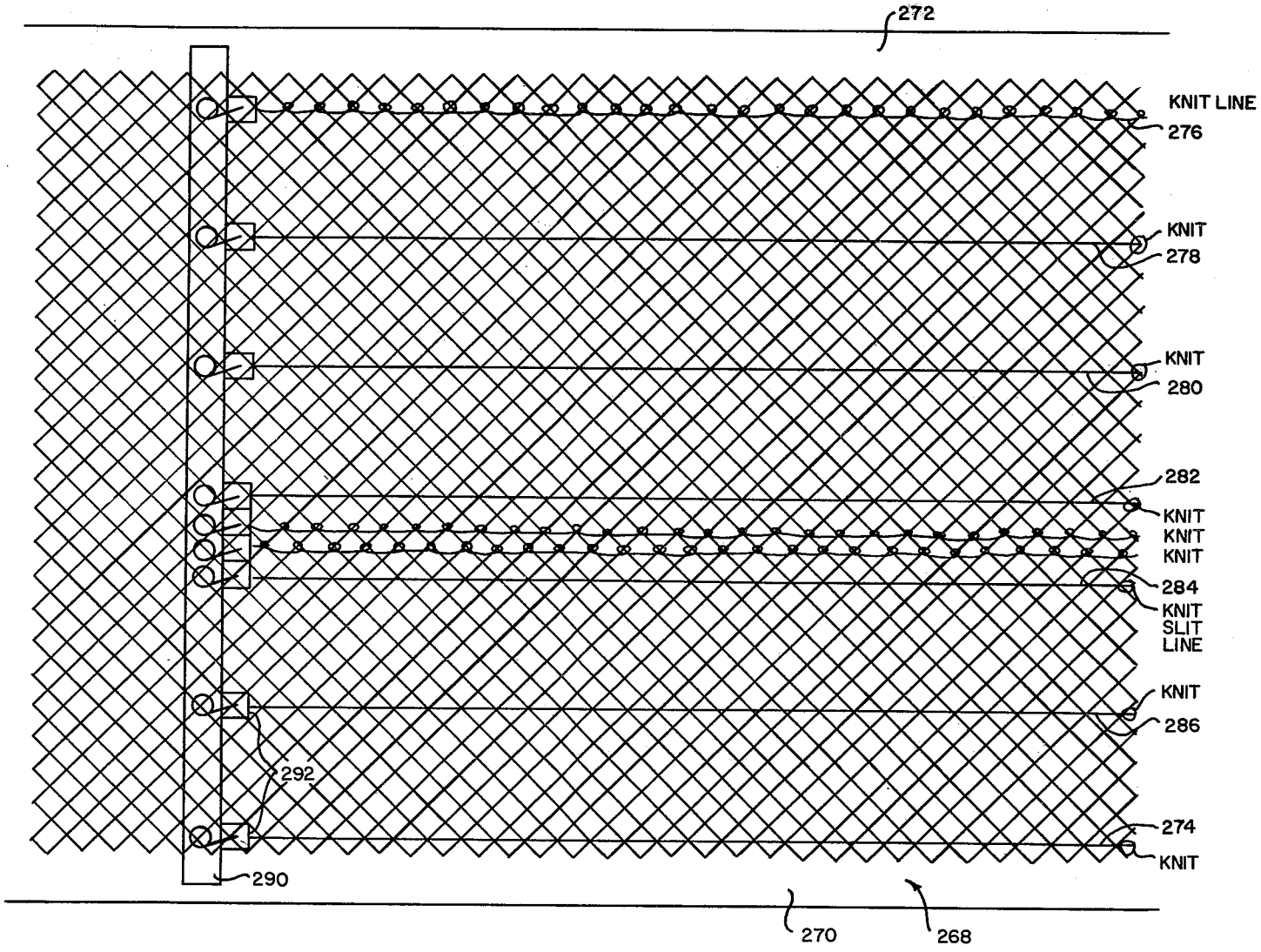
FIG. 14 is a plan view of a length of bias fabric which is being stabilized by knitting threads along the length thereof.

FIG. 14 depicts a ±45° bias fabric 268 mounted on an opposite pair of conveyors 270 and 272 and which has been made by any of the techniques previously described. FIG. 14 illustrates one technique for stabilizing the fabric 268 in which threads of appropriate material are stitched along the length of the fabric 268 at selected locations across the width of the fabric. In the example of FIG. 14 a thread 274 is stitched along the length of the fabric adjacent the conveyor 270, while a thread 276 is stitched along the length of the fabric adjacent the conveyor 272. The threads 274 and 276 greatly aid in stabilizing the opposite edges of the fabric 268 upon removal thereof from the pins on the conveyors 270 and 272 by an upward lifting motion. Other threads 278, 280, 282, 284 and 286 are spaced across the width of the fabric 268 to enable the fabric to be handled without disturbing the positions of the various yarns.

As shown in FIG. 14 a conventional multiple head stitching unit 290 is used to stitch the various threads. The unit 290 includes a bobbin-carrying mechanism positioned under the fabric 268 and providing a different thread for each individual stitching head 292. At each penetration of the stitching needle from one of the heads 292, the thread carried by the stitching needle becomes engaged by the thread carried by an associated bobbin beneath the fabric 268, and this creates a line of stitching along the length of the fabric.

As an alternative to the stitching process, a multiple knitting unit may be used. A knitting operation normally uses a single yarn system, that is one knitting yarn for each line while the stitching type operation generally involves two yarns per line of stitches. Other differences exist in the type of needles, but either technique may be used.

Figure 15:
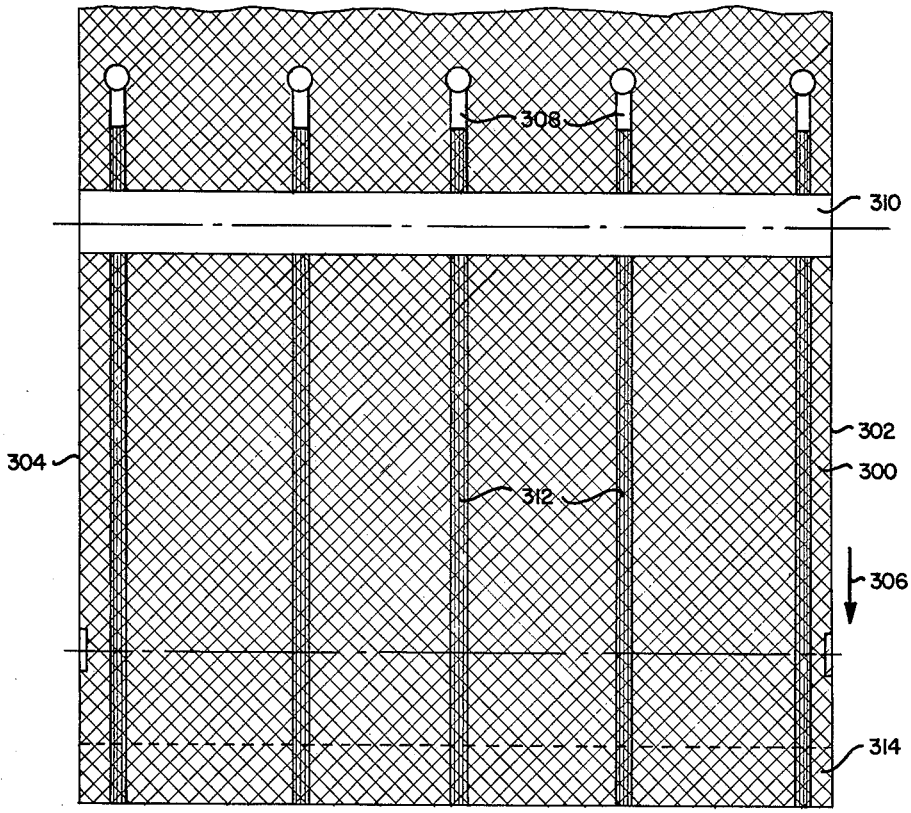
FIG. 15 is a plan view of a length of bias fabric which is being stabilized by deposition of lines of hot plastic material thereon.

FIG. 15 depicts an alternative technique for stabilizing a bias fabric 300. The fabric 300 is supported at its opposite edges by conveyors 302 and 304 which move the fabric 300 in a direction shown by an arrow 306. The fabric 300 is carried below a series of small extruding nozzles 308 which deposit beads of hot plastic material on the top surface of the fabric. Immediately downstream of the nozzles 308 is a pressure roll 310 which engages the top surface of the fabric 300 across the width thereof. A mating pressure roll (not shown) disposed on the opposite side of the fabric 300 from the roll 310 squeezes the fabric between itself and the roll 310. The pressure roll 310 and its mating pressure roll press the molten or liquid plastic material extruded by the nozzles 308 into contact with both plies of the fabric 300. Downstream of the pressure roll 310 the fabric 300 may be heated or cooled as dictated by the characteristics of the plastic material. Where the plastic material comprises a resin, a sufficient length of the conveyors 302 and 304 is provided downstream of the pressure roll 310 to permit partial curing or setting of the resin. The fabric 300 as stabilized by beads 312 of the plastic material is lifted from the ends of the conveyors 302 and 304 and is wound on a roll 314.

In the arrangement of FIG. 15 the individual beads 312 of plastic material are formed in spaced-apart relation along the length of the fabric 300 to stabilize the fabric on removal from the conveyors. As noted above the beads 312 can comprise any appropriate plastic material including thermosetting resins. Various applications of bias fabrics require that the fabric be impregnated with a thermosetting resin and cured. Where this requirement is present, the application of the resin and at least some curing thereof can be achieved before removing the fabric from the conveyors so as to stabilize the fabric. This is accomplished by an arrangement similar to that of FIG. 15 except that the nozzles 308 are adjusted or more or them are added as required so as to deposit resin over the entire surface of the fabric 300. Alternatively, the resin can be sprayed on the fabric 300 by other means, or applied by a roller coater. A sufficient length of the conveyors 302 and 304 downstream of the nozzles is provided to allow the resin to be heated to the desired stage of curing before removal from the conveyors.

In accordance with a still further stabilization technique a length of film of Mylar or similar material having a width at least equal to that of the fabric is applied to one surface of the fabric by providing at least one surface of the film with an adhesive coating. The film is applied to either of the opposite surfaces of the fabric and is preferably pressed firmly into place by pressure rolls to insure adhesive contact with both plies of the fabric. The film provides stabilization of the fabric upon removal of the conveyors and itself can be removed from the fabric at a later processing step such as upon resin impregnation and curing. As described hereafter in connection with FIGS. 16–19 the groups of yarns used in forming a fabric can be attached to strips of film prior to disposition of the yarns and included film strips across the width of the fabric to form the fabric. In such instances the film strips can be adhesive coated or coated with resin in conjunction with the yarns, with the net result that the various film strips form a film backing or support which stabilizes the fabric upon removal from the conveyors.

Figure 16:
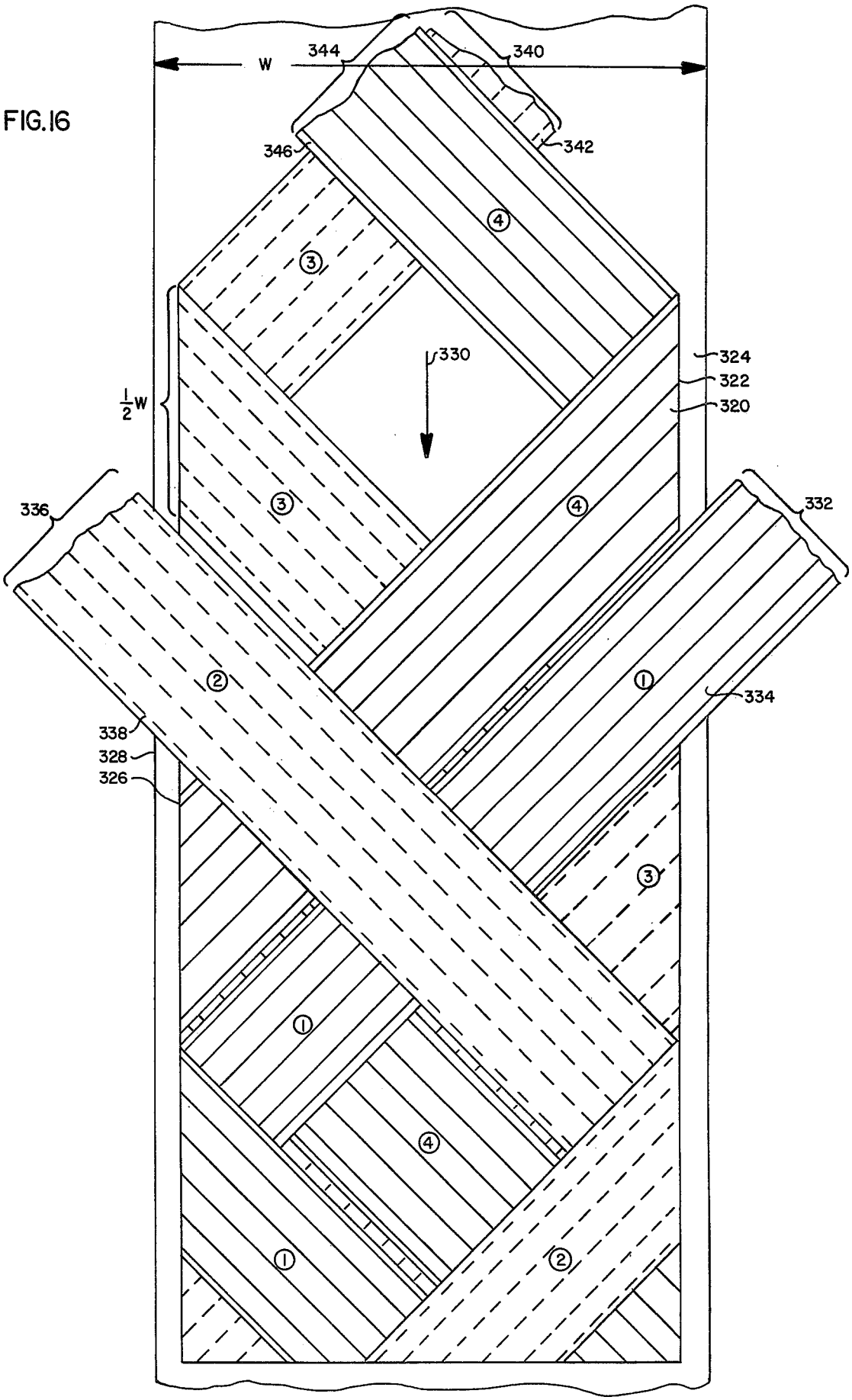
FIG. 16 is a plan view of a bias fabric being formed by a plurality of length of film having yarns mounted on the film.

The bias fabric described thus far are formed by wrapping groups of yarns around pins on conveyors at the opposite edges of the fabric being formed. FIG. 16 depicts an alternative technique for forming a bias fabric in which the groups of yarns are mounted on strips of film prior to being repeatedly extended between an opposite pair of conveyors to form the fabric. The fabric 320 shown in FIG. 16 has a right edge 322 supported on a conveyor 324 and a left edge 326 supported on a conveyor 328. The conveyors 324 and 328 are assumed to move in a direction shown by an arrow 330.

The fabric 320 is comprised of four different groups of yarns which are oriented at angles of +45° and −45° relative to the long axis of the fabric so as to have a width along either of the opposite edges 322 and 326 equal to one-half W where W is the width of the fabric 320. A first group 332 of yarns includes a length of film 334 attached thereto. For convenience of illustration the first yarn group 332 and the included length of film 334 are designated ① in FIG. 16. A second yarn group 336 and an attached length of film 338 are designated ② in FIG. 16. A third yarn group 340 and included length of film 342 are designated ③ in FIG. 16. A fourth yarn group 344 and included length of film 346 are designated ④ in FIG. 16. The four different yarn groups 332, 336, 340 and 344 are extended across the width of the fabric 320 in much the same manner as in the case of FIG. 9, except that in FIG. 16 each yarn group is mounted on a different length of film.

The lengths of film 334, 338, 342 and 346 enable the different yarn groups which are attached thereto to be laid back and forth across the width of the fabric without the need for accurately positioning and wrapping each yarn around a different pin at the opposite conveyors. Accordingly, the task of laying in the different yarn groups to form the fabric is made much easier. Moreover, the different lengths of film which are normally provided with an adhesive on at least one surface thereof for securing the associated yarn group in place can be resin coated or otherwise provided with an adhesive on the opposite surface to aid in bonding the film strip to other yarns and film strips to stabilize the fabric.

Figure 17:
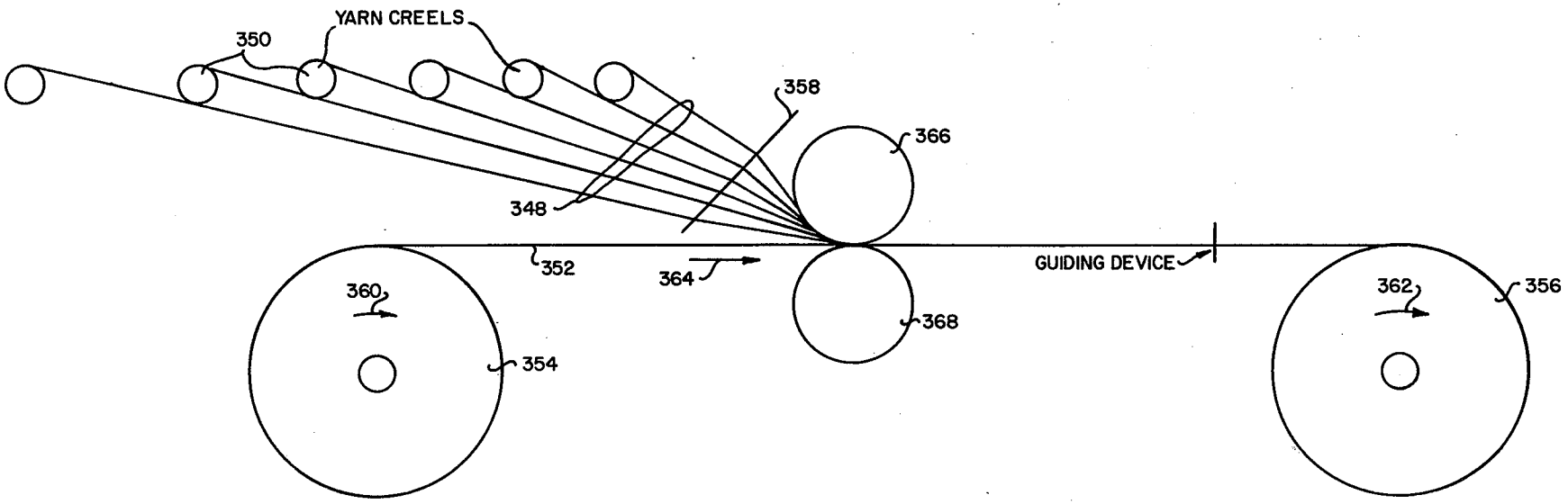
FIG. 17 is a side view of an arrangement for mounting a plurality of yarns on a length of film of the type shown in FIG. 16.

The various yarn groups 332, 336, 340 and 344 can be mounted on the respective lengths of film 334, 338, 342 and 346 using any appropriate technique and apparatus. However, one technique and the apparatus used in conjunction therewith is illustrated in FIG. 17. FIG. 17 depicts a yarn group 348 drawn from individual creels 350. A length of film 352 extends from a supply roll 354 to a take-up roll 356. The length of film 352 is arranged so that the surface thereof on the outer side of the rolls 354 and 356 has an adhesive coating.

The individual yarns as drawn from the creels 350 extend through apertures in a yarn guide 358. The guide 358 is disposed at an angle so as to dispose the different yarns of the group 348 at different longitudinal positions across the width of the film 352. The rolls 354 and 356 are rotated in the directions shown by arrows 360 and 362 respectively to advance the film 352 past the guide 358 in a direction shown by an arrow 364. As the film 352 is advanced, the individual yarns of the group 348 are laid down on the outer surface of the film by an opposite pair of pressure rolls 336 and 368 disposed on opposite sides of and in contact with the film 352. The pressure from the opposing rolls 366 and 368 forces the yarns into contact with the adhesive coated film 352, following which the film and included yarns is wound upon the take-up roll 356.

The various yarn groups and included film strips shown in FIG. 16 can be secured to the opposite conveyors 324 and 328 by any appropriate means. One preferred arrangement for securing the yarns and included film strips is shown in FIGS. 18 and 19. FIGS. 18 and 19 depict yarn laying apparatus 370 which is movable laterally across the width of the fabric 320 by opposite pairs of wheels 372 and 374 mounted on tracks 376 and 378 respectively. The tracks 376 and 378 extend across the width of the fabric 320 and beyond the opposite edges 322 and 326. Only the righthand edge 322 of the fabric 320 and adjacent portions of the tracks 376 and 378 are shown in FIG. 18.

The yarn laying apparatus 370 includes a frame 380 extending between the opposite tracks 376 and 378 and mounting the opposite pairs of wheels 372 and 374. The frame 380 may be moved back and forth across the width of the fabric 320 by means of the wheels 372 and 374 and the tracks 376 and 378. The frame 380 supports a roll of film 382 at the underside thereof. The roll of film 382 has a group of yarns affixed thereto such as by use of the process described in connection with FIG. 17. The roll of film 382 is suspended from the frame 380 by a trunnion 384 which is pivotably disposed within the center of the frame 380 and which can be rotated relative to the frame 380 through an angle of at least 90° via a gear 386 coupled to the trunnion 384 just above the frame 380 and a gear 388 which meshes with the gear 386 and which is coupled to a motor or other appropriate drive source for rotating the trunnion 384 and the included film roll 382.

Disposition of the roll of film 382 and the included yarns across the width of the fabric 320 is accomplished by moving the frame 380 along the tracks 376 and 378 as the opposite conveyors move the fabric 320 longitudinally. By positioning the trunnion 384 at an angle of 45° relative to the frame 380, and by advancing the conveyors at a speed equal to the speed of advancement of the frame 380 across the tracks 376 and 378, the film 382 is laid across the width of the fabric 320 at an angle of 45° relative to the long axis of the fabric as seen in FIG. 18. When the frame 380 reaches the position shown in FIG. 18 at the edge 322 of the fabric 320, the conveyor stops and the frame 380 continues a slight distance beyond the position shown. At that point an elongated arm 390 which is pivotably mounted adjacent the edge 322 of the fabric 320 is pivoted from a neutral position shown in FIG. 18 in which it generally parallels the track 378 to an operative position in which it passes over the top of the film 382 so as to press the film down onto the pins on the conveyor disposed thereunder. The arm 390 is swung into a position in which it is disposed immediately above the edge 322 of the fabric 320 as shown in FIG. 18. With the arm 390 in this position, the gear 388 is driven to rotate the gear 386 and the included trunnion 384 in a counterclockwise direction through an angle of 90°. Movement of the frame 380 toward the opposite side of the fabric 320 is then begun, and at the same time the arm 390 is swung away from the film 382 and into the neutral position. Movement of the opposite conveyors is begun as the frame 380 reaches the edge 322 of the fabric 320 and starts across the width of the fabric. This disposes the film 382 at an angle of −45° with respect to the long axis of the fabric 320 across the fabric width. When the frame 380 reaches the opposite edge of the fabric 320, the conveyors are halted and movement of the frame 380 along the tracks 376 and 378 is halted shortly thereafter. An arm similar to the arm 390 and pivotably mounted adjacent the opposite edge of the fabric is swung into the operative position to force the film and included yarns down onto the pins on the conveyor. The trunnion 384 is then rotated 90° in the clockwise direction until it assumes the orientation shown in FIG. 18, whereupon the arm is moved out of the way in preparation for a pass of the yarn laying apparatus 370 across to the edge 322 of the fabric 320.

In the fabric example of FIG. 16, four different yarn groups and included film strips are employed. To make such a fabric four of the yarn laying apparatus 370 shown in FIGS. 18 and 19 are required. The four different apparatus are spaced apart along the length of the fabric so that the different film strips and included yarns are disposed across the width of the fabric in a desired order as shown in FIG. 16.

Figure 20:
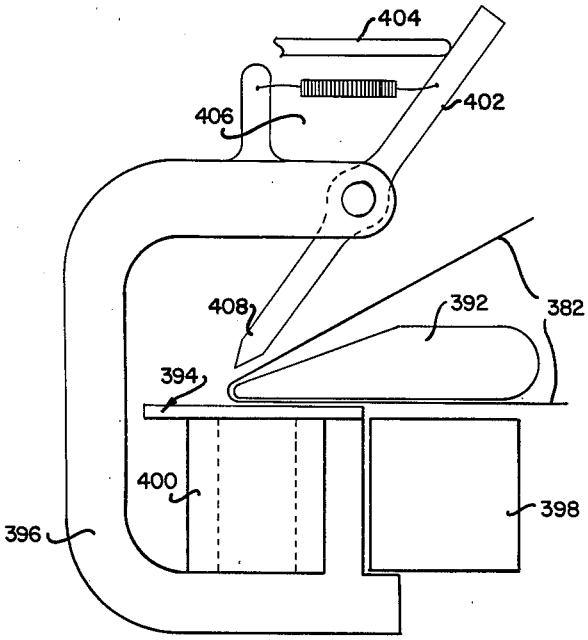
FIG. 20 is a side view of an alternative arrangement for laying on a film in the arrangement of FIG. 16.
Figure 21:
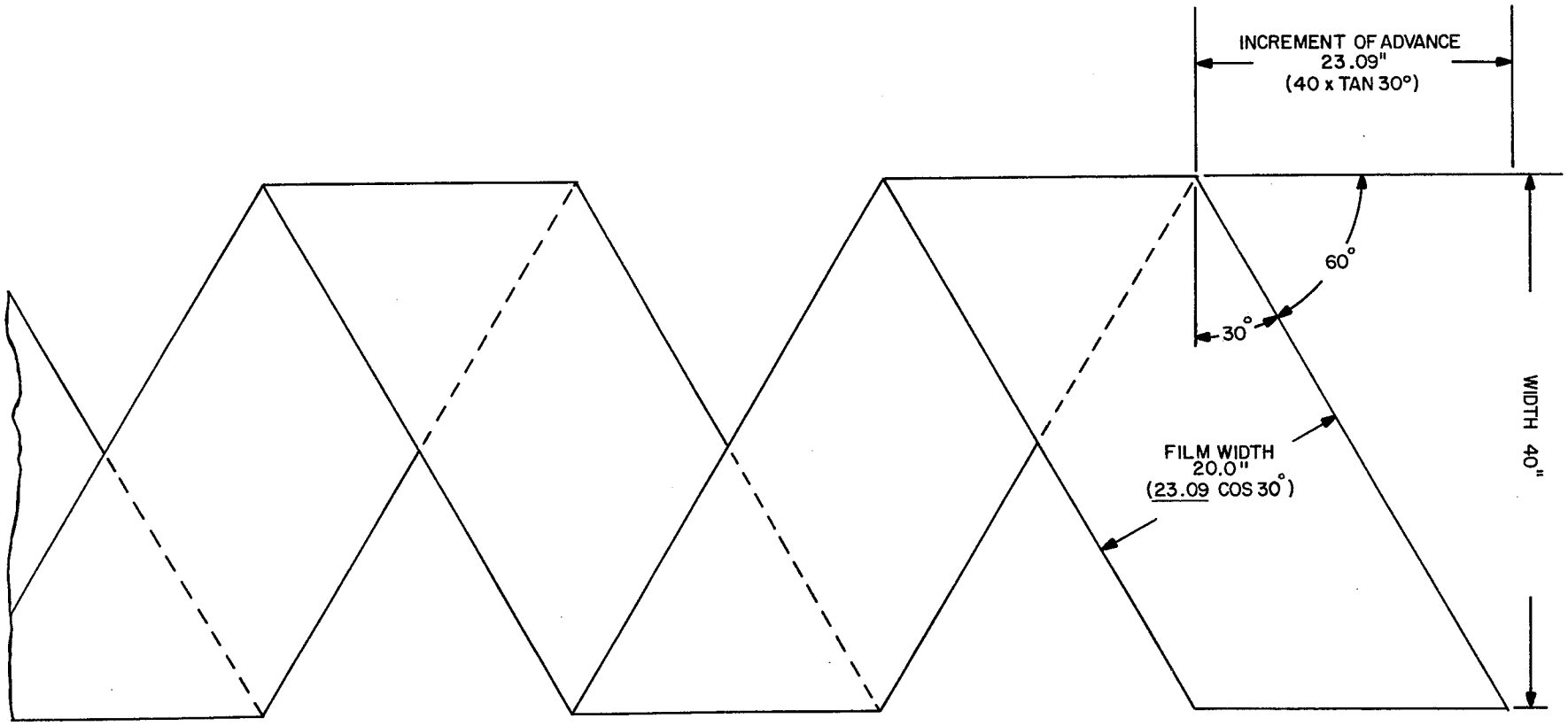
FIG. 21 is a plan view of a length of bias fabric having a yarn angle of 60° relative to the long axis of the fabric.

The yarn laying apparatus 370 of FIGS. 18 and 19 is described in connection with opposite conveyors having pins thereon. However, the same results can be accomplished using a conventional clip type tenter chain. FIG. 20 illustrates the use of a clip tenter in such instances. The film 382 is folded into position by a folding arm 392 positioned on top of a machined plate 394. A clip body 396 which supports the plate 394 and which is disposed adjacent a guide rail 398 and a link 400 which connects adjacent clip bodies to form a frame supports a clip jaw 402 at the upper end thereof. The clip jaw 402 which is normally held in open position by a camming bar 404 rotates under the urging of a spring 406 when the camming bar 404 is moved to the left as seen in FIG. 20 to permit a lower end 408 of the clip jaw 402 to fold the film 382 against the folding arm 392. The width of the film strips is determined by the bias angle and the width of the fabric being formed. In the example of FIG. 16 each film strip has a length in the direction of the long axis of the fabric equal to one-half W. The bias angle is 45°. Accordingly, the width of each film strip is $\frac{1}{2}$ W Cos 45°. However, as previously noted the bias angle need not be 45°. In some cases the bias angle can be 30° or even 60° depending on the ultimate use of the fabric. Regardless of the bias angle, the film width is easily determined simply by knowing the bias angle and the width of the fabric to be formed. FIG. 21 provides an example in which the bias angle is 60° and the width of the fabric to be formed is 40″. If it is assumed that the fabric is to be formed using two film strips, then the length of each film strip along either of the opposite fabric edges is 40 Tan 30° or 23.09″. The width of the film strips therefore becomes 23.09 Cos 30° or 20″.

Figure 22:
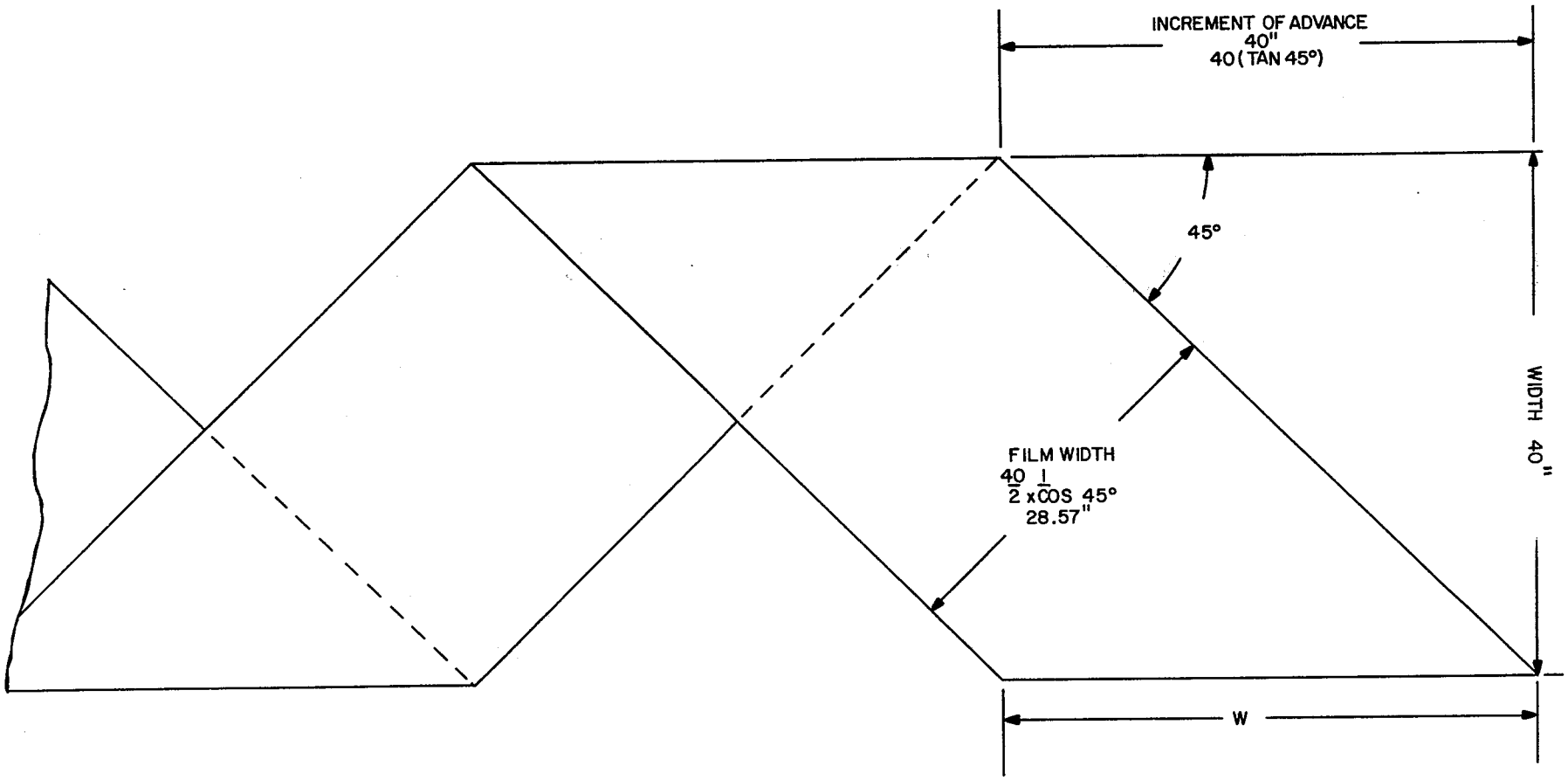
FIG. 22 is a plan view of a length of bias fabric having a yarn angle of 45° relative to the long axis of the fabric.

An example of a fabric having the same width and the same number of film strips but a bias angle of 45° is shown in FIG. 22. In this example the length of each film strip along the long axis of the fabric is 40 Tan 45° or 40″. The width of the film strip is 40 Cos 45° or 28.57″.

Figure 23:
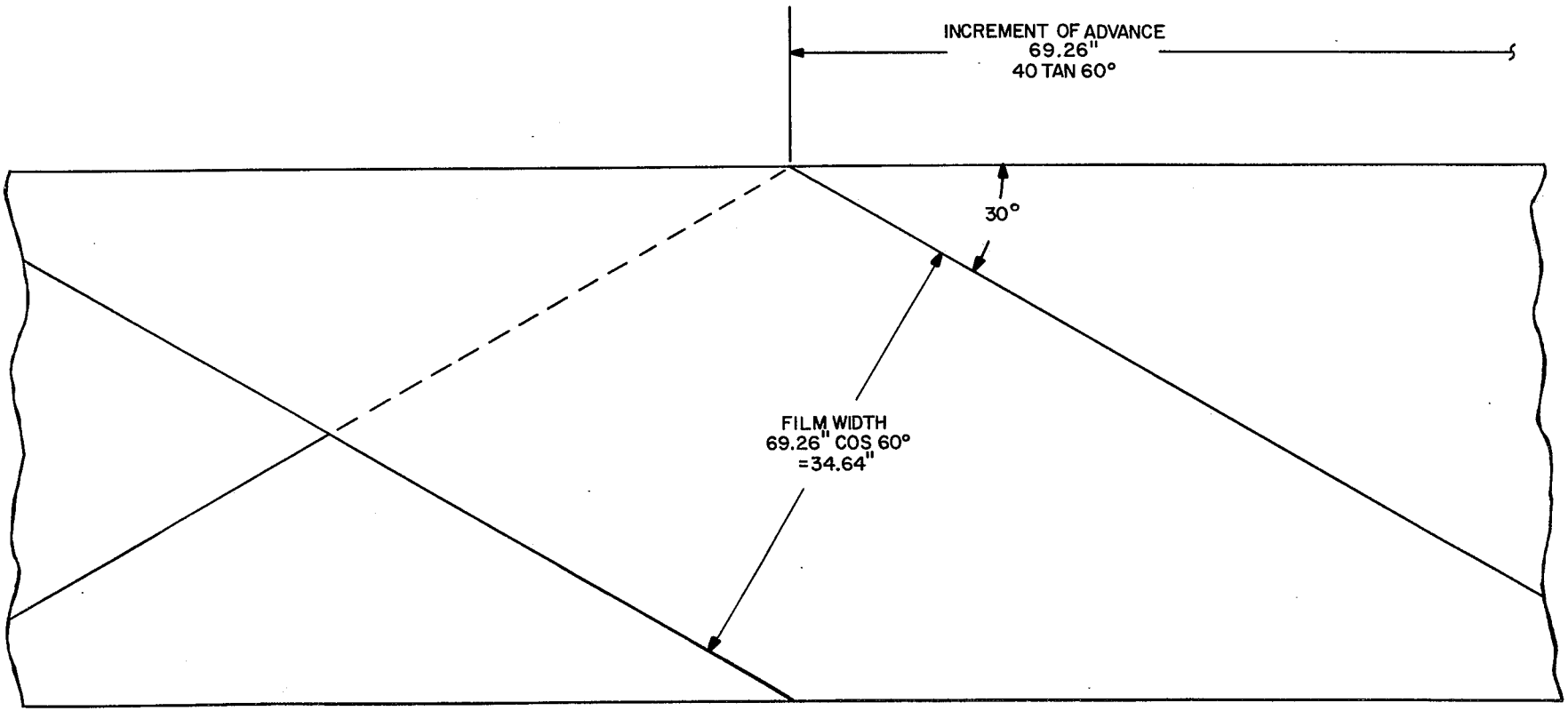
FIG. 23 is a plan view of a length of bias fabric having a yarn angle of 30° relative to the long axis of the fabric.

FIG. 23 illustrates an example in which two film strips are used and the fabric width is 40″ but the bias angle is 30°. The length of each film strip in the direction of the long axis of the fabric is therefore 40 Tan 60° or 69.26″. The width of each film strip is 69.26 Cos 60° or 34.64″.

Although two somewhat dissimilar approaches have been described for the fabrication of bias fabrics, one by means of laying yarns of a group around pins on a conveyor and the other by laying down a film strip to which the yarns have previously been adhered, it will be understood by those skilled in the art that the various techniques described in connection with one approach applied to the other approach as well. For example, the arm 390 shown in FIGS. 18 and 19 can be used with individual yarns as well as with film strips. In addition, the capability of utilizing different bias angles as discussed in connection with FIGS. 21–23 also apply to cases where yarn groups are used without the film strips.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A bias fabric having a pair of opposite sides extending along the length thereof and a generally uniform width between the pair of opposite sides and principally consisting of a plurality of generally parallel, spaced-apart yarns having a density of at least about 12 yarns per inch and extending back and forth across the width of the fabric and forming angles of approximately 45° with the opposite sides of the fabric, the plurality of yarns repeatedly intersecting each of the opposite sides of the fabric with each intersection of the plurality of yarns with one of the opposite sides occurring along a portion of the side equal to approximately twice the width of the fabric, the yarns consisting of material which is relatively porous and which is suitable for impregnation with and at least partial curing of a resin.

2. The invention set forth in claim 1, wherein in a given direction along the length of the fabric the plurality of yarns form a bundle which intersects each of the opposite sides and then extends over itself and into intersection with the opposite side.

3. The invention set forth in claim 1, wherein the bias fabric includes means for stabilizing the fabric, the means for stabilizing extending along the length of the fabric and across at least a portion of the width of the fabric and binding adjacent portions of the yarns together.

4. A bias fabric having a pair of opposite sides extending along the length thereof and principally consisting of a plurality of yarns, the yarns being arranged to divide the length of the fabric into a succession of triangles, each triangle extending across the width of the fabric and being comprised of an upper layer of generally parallel, spaced-apart yarns having a density of at least about 12 yarns per inch and a lower layer of generally parallel, spaced-apart yarns having a like density and disposed generally at right angles to the yarns in the upper layer, the yarns forming the upper layer of a given triangle connecting with and forming the lower layer of a first adjacent triangle on one side of the given triangle and the yarns forming the lower layer of the given triangle connecting with and forming the upper layer of a second adjacent triangle on a different side of the given triangle from said one side, the yarns consisting of material which is relatively porous and which is suitable for impregnation with and at least partial curing of a resin.

5. The invention set forth in claim 4, wherein the bias fabric includes means for stabilizing the fabric, the means for stabilizing extending along the length of the fabric and across at least a portion of the width of the fabric and binding adjacent portions of the yarns together.

6. A bias fabric having a pair of opposite sides extending along the length thereof and principally consisting of a top layer of yarn extending in generally parallel, spaced-apart relation across the fabric between the opposite sides and forming angles of approximately 45° with each of the opposite sides and a bottom layer of yarn disposed beneath the top layer and extending in generally parallel, spaced-apart relation across the fabric between the opposite sides and forming angles of approximately 45° with each of the opposite sides and angles of approximately 90° with the yarns in the top layer, the top layer being formed by a first plurality of generally continuous yarns extending back and forth across the fabric between the opposite sides and the bottom layer being formed by a second plurality of generally continuous yarns extending back and forth across the fabric between the opposite sides, the top layer of yarn and the bottom layer of yarn each having a density of at least about 12 yarns per inch and consisting of material which is relatively porous and which is suitable for impregnation with and at least partial curing of the resin.

7. The invention set forth in claim 6, wherein the bias fabric includes means for stabilizing the fabric, the means for stabilizing extending along the length of the fabric and across at least a portion of the width of the fabric and binding adjacent portions of the yarns together.

8. A bias fabric comprising the combination of:

a plurality of film strips of generally uniform width, each of the film strips alternately extending back and forth across the width of a bias fabric formed thereby; and a different plurality of yarns secured to each of the film strips, each plurality of yarns extending in generally parallel, spaced-apart relation along the length of the film strip.

9. The invention set forth in claim 8, further including a length of film secured to the bias fabric, the length of film extending along the length of the fabric and across at least a substantial portion of the width of the fabric.

* * * * *